US005806396A

United States Patent [19]

Watanabe

[11] Patent Number: 5,806,396

[45] Date of Patent: Sep. 15, 1998

[54] AUTOMATIC FABRIC PATTERN MATCHING APPARATUS

[75] Inventor: Kenichi Watanabe, Yonago, Japan

[73] Assignee: Kabushiki Kaisha NCA, Osaka, Japan

[21] Appl. No.: 757,250

[22] Filed: Nov. 27, 1996

Related U.S. Application Data

[63] Continuation of Ser. No. 290,874, filed as PCT/JP93/00052, Jan. 14, 1993, abandoned.

[51] Int. Cl.[6] ..... B26D 5/00

[52] U.S. Cl. ..... 83/367; 83/86; 83/90; 83/91; 83/153; 83/938

[58] Field of Search ..... 83/367, 649, 937, 83/938, 939, 614, 508, 451, 86, 90, 91, 153, 151, 156

[56] References Cited

U.S. PATENT DOCUMENTS

| | | | |
|---|---|---|---|
| 3,783,728 | 1/1974 | Glasman et al. | 83/633 X |
| 4,034,634 | 7/1977 | Arbter | 83/649 |
| 4,401,001 | 8/1983 | Gerber et al. | 83/508 |
| 4,519,595 | 5/1985 | Adachi | 83/937 |
| 4,616,543 | 10/1986 | Gerber | 83/649 |
| 4,853,866 | 8/1989 | Andrada Galan | 364/470 |
| 5,033,341 | 7/1991 | Mussig et al. | 83/937 |
| 5,085,111 | 2/1992 | Birkhofer | 83/91 |
| 5,193,424 | 3/1993 | Minichshofer et al. | 83/937 |
| 5,463,921 | 11/1995 | Bellio et al. | 83/937 |

FOREIGN PATENT DOCUMENTS

| | | | |
|---|---|---|---|
| 2048265 | 2/1992 | Canada | 83/86 |
| 684615 | 12/1939 | Germany | 83/86 |
| 50-112556 | 9/1975 | Japan . | |
| 60-195407 | 10/1985 | Japan . | |
| 1-33587 | 7/1989 | Japan . | |
| 2-46708 | 10/1990 | Japan . | |
| 244290 | of 1969 | Russian Federation | 83/86 |

*Primary Examiner*—Maurina T. Rachuba
*Attorney, Agent, or Firm*—Jones, Tullar & Cooper, P.C.

[57] ABSTRACT

An automatic fabric pattern-matching apparatus for, a fabric (MA) which has a pattern continuous at least in the lateral direction and which is unwound and spread from a wound fabric (M) and is fed from one end thereof in the longitudinal direction of the fabric in a hanging manner via a feeding mechanism of the fabric pattern-matching apparatus. The surface of the hanging portion of the fabric (MA) fed in the hanging manner is read by a CCD camera functioning as an optical reading apparatus, so that the vertical position of the fabric (MA) is controlled for aligning the fabric pattern so as to form a lateral straight line, based on the read signal. As a result, disadvantageous phenomena such as bias or bowed patterns created by gravity are eliminated, thereby eliminating defective products due to the disadvantageous phenomena noted. Also, a pattern matching operation of a fabric, which is conventionally considered difficult, can be surely, precisely, and efficiently realized by the automatic fabric pattern-matching apparatus.

6 Claims, 29 Drawing Sheets

AUTOMATIC FABRIC PATTERN MATCHING APPARATUS

This is a continuation of application Ser. No. 08/290,874, filed as PCT/JP93/00052, Jan. 14, 1993, now abandoned.

TECHNICAL FIELD

The present invention relates to an automatic fabric pattern-matching apparatus, and particularly to an automatic fabric pattern-matching apparatus with functions which are useful when a pattern formed on the fabric is continuous at least in a lateral direction, for example, when the pattern is a lateral stripe pattern, a lattice pattern, or the like.

BACKGROUND ART

In recent years, fabrics of various materials have become commercially available as yard goods for European clothes, Japanese clothes, and the like. For example, a warp knitted fabric is generally produced as follows: A tubular knitted fabric is first dyed and finished, and then cut and unfolded. Thereafter, the fabric is wound on a core rod into a round form. In the case where a material fabric which is wound as described above is to be unwound for the purpose of tailoring, the fabric is drawn out from the wound fabric and cut into a predetermined size. Multiple fabrics thus obtained are piled up, and then cut out so as to have a desired shape by using a cutting device or the like. In this case, when the fabrics are piled up, it is necessary to perform the pattern matching for each of the fabrics. Particularly in the case where the pattern formed on the fabric is a stripe pattern or a lattice pattern, inaccurate pattern matching may result in poor products which include bias or bowed patterns or the like, or may result in undesired variations in pattern of products.

In general, when such a fabric pattern matching is to be performed in the prior art, workers manually conduct the pattern matching carefully for each of the fabrics so that the pattern on the fabric is not bowed, and the patterns are matched for all the piled fabrics.

However, in the fabric on which the stripe pattern or the lattice pattern is formed as described above, there already exists a bias or bowed pattern or the like to some degree when the fabric is drawn out from the wound fabric. Such a bias or bowed pattern appears as a kink on the drawn fabric. When the pattern matching is performed during the piling of fabrics, therefore, it is necessary to conduct a piling-up operation in which a number of workers pile the fabrics one by one while each of the workers confirms the pattern positions. Accordingly, an excess number of workers and labors are required, so that the operation is complicated and troublesome. This inevitably results in deterioration of operation efficiency and productivity. In addition, the above-described pattern matching is conventionally performed by placing and piling the piece goods on an upper face of a working table, i.e., on a horizontal face. When a fabric which is spread horizontally is to be piled, there always occur shrinkage or stretch in the fabric, resulting in that it is considerably difficult to manually perform the pattern matching operation.

SUMMARY OF THE INVENTION

It is the principal object of the present invention to provide an automatic fabric pattern-matching apparatus which can automatically perform the fabric pattern-matching operation that is conventionally considered difficult because of various properties inherent to a knitted fabric and the like, whereby productivity can be improved.

It is another object of the present invention to realize an extremely precise and excellent pattern matching without damaging the fabric and without causing wave and crease during the pattern matching operation.

It is a further object of the present invention to reduce the size of the whole apparatus so as to attain an economic effect due to the reduction of the space for mounting the apparatus.

In order to attain the above-mentioned objects, a first automatic fabric pattern-matching apparatus of the present invention is an apparatus for automatically performing pattern matching of a fabric having a pattern which is continuous at least in a lateral direction, the apparatus comprising: a fabric feeding mechanism for feeding the fabric which is unwound from a wound fabric to be spread, from one end thereof in a longitudinal direction in a hanging manner; optical reading means, disposed so as to oppose a front face of the hanging portion of the fabric which is fed in the hanging manner, for recognizing the pattern on the fabric; and control means for controlling the position of the fabric in the longitudinal direction based on a signal from the optical reading means, so that the pattern which is continuous in the lateral direction of the fabric forms a lateral straight line.

According to a first automatic fabric pattern-matching apparatus having the above-described construction, the fabric unwound and spread from the wound fabric is fed from one end thereof in a lateral direction in a hanging manner by the feeding mechanism, and hence disadvantageous phenomena such as bias or bowed patterns in the hanging portion are eliminated due to gravity. The optical reading means directed to the hanging portion of the fabric reads the difference in color and the color gradation in the pattern of the fabric. The position of the fabric in the longitudinal direction is controlled and determined so that the pattern which is continuous in the lateral direction of the fabric forms a lateral straight line. If the fabric is cut under this state so as to have a predetermined size, the succeeding piling-up operation and the cutting operation can be performed in a satisfactory manner while the adverse influences due to the bias and bowed patterns, etc. are eliminated.

The second automatic fabric pattern-matching apparatus of the present invention comprises: an automatic fabric unwinding device for unwinding a fabric from a wound fabric which is formed by winding the fabric; a fabric feeding mechanism for feeding the fabric which is unwound from a wound fabric to be spread, from one end thereof in a longitudinal direction in a hanging manner; optical reading means, disposed so as to oppose a front face of the hanging portion of the fabric which is fed in the hanging manner, for recognizing the pattern on the fabric; a fabric receiving and supporting plate disposed so as to oppose the back face of the hanging portion of the fabric, the plate having a slope for receiving and supporting the hanging portion of the fabric in a state where the lower portion is more displaced backward; a plurality of pattern matching units, disposed so as to be movable backward and forward and in the longitudinal direction on the back side of the fabric receiving and supporting plate, for controlling the position of the fabric in the longitudinal direction so that the pattern which is continuous in the lateral direction of the fabric forms a lateral straight line, by inserting pattern matching needles into the fabric based on a signal from the optical reading means; and a fabric cutting device, disposed under the optical reading means so as to be movably backward and forward, for cutting the fabric which has been subjected to the pattern matching by the pattern matching units, in a width direction thereof.

According to the second automatic fabric pattern-matching apparatus with the above-described construction, it is a matter of course that, similar to the first apparatus, the succeeding piling-up operation and the cutting operation can be performed in a satisfactory manner while the adverse influences due to the bias and bowed patterns, etc. are eliminated. In addition, during the above-mentioned pattern matching and cutting operations, the fabric hanging portion fed in the longitudinal direction in the hanging manner is received and supported by the slope of the fabric receiving and supporting plate disposed on the back side in such an inclined manner that the lower portion is more displaced backward. Even if the fabric hanging portion is deformed to wave, or even if it includes creases, therefore, the pattern matching needles can be inserted after the hanging portion is corrected to be flat and stably supported. Accordingly, deviation in needle inserting positions and the escape of the fabric do not occur, and it is possible to eliminate the cutting failure and the deviation in cutting positions because of the escape of the fabric in the cutting operation. Therefore, the needle insertion into the predetermined position of the fabric hanging portion and the cutting along the predetermined position can be surely and precisely performed. This enables the fabric pattern matching operation which is conventionally considered difficult because of various properties of knitted fabric and the like, to be automatically performed, and hence productivity can be improved. Moreover, it is possible to realize extremely precise and excellent pattern matching without damaging the fabric and without causing wave and crease.

The second automatic fabric pattern-matching apparatus may be configured so that a fabric pressing device which presses the front side of the fabric hanging portion received and supported on the slope of the fabric receiving and supporting plate against the slope is mounted at a position opposing the front face of the fabric hanging portion and rotatable about a shaft to be moved in a pressure releasing direction, the shaft being set above the fabric pressing position, and the fabric pressing device comprises an air blowing device which blows air toward the fabric hanging portion during the rotation and motion in the pressure releasing direction. In this configuration, the front face of the fabric hanging portion which is received and supported on the slope of the fabric receiving and supporting plate in a flat state is pressed against the slope by the fabric pressing device, whereby the fabric escape preventing function is more surely maintained during needle insertion and the cutting operation. In addition, when the fabric pressing device is rotated and moved in the pressure releasing direction after the needle insertion, air is blown toward the fabric hanging portion from the air blowing device provided for the fabric pressing device. Accordingly, it is possible to surely prevent the needles inserted in the fabric hanging portion from slipping out, and hence is possible to further improve the precision of the prescribed pattern matching.

The second automatic fabric pattern-matching apparatus may be configured so that the fabric feeding mechanism comprises: a fabric lower end position detection sensor for detecting a lower end position of the unwound fabric; a roller which is moved forward based on a detection signal of the sensor; a deflection detection sensor for detecting whether a slack amount of the fabric which is slacked in a substantially U-shape between the roller and the automatic fabric unwinding device reaches a predetermined amount or not; and a motor for rotating the roller. In this configuration, it is possible to smoothly feed the fabric without producing undue stress, and without giving an excess pulling force to the fabric.

A roller constituting the automatic fabric unwinding device, and a roller constituting a part of the fabric feeding mechanism may be configured so as to be moved in right and left or lateral directions based on a detection signal of an edge detection sensor for detecting an edge of the fabric. According to this configuration, even when there exists deviation in the width direction of the fed fabric, the deviation can be automatically corrected and the edge can be arranged properly.

In a configuration wherein the automatic fabric unwinding device, the fabric feeding mechanism, the optical reading means, a unit box for accommodating the pattern matching units, and the fabric cutting device are arranged in predetermined positional relationships, and integrally coupled and supported by right and left device frames, it is unnecessary to provide a large space for each of the plurality of steps such as the unwinding of the wound fabric, the pattern matching of the unwound fabric, and the cutting of the fabric which has been subjected to the pattern matching. Accordingly, it is possible to reduce the size of the whole automatic fabric pattern-matching apparatus as small as possible. Therefore, the locating space can be saved as much as possible, and it is possible to attain a great economic effect in a space factor.

DESCRIPTION OF PREFERRED EMBODIMENTS OF THE INVENTION

Figure 1:
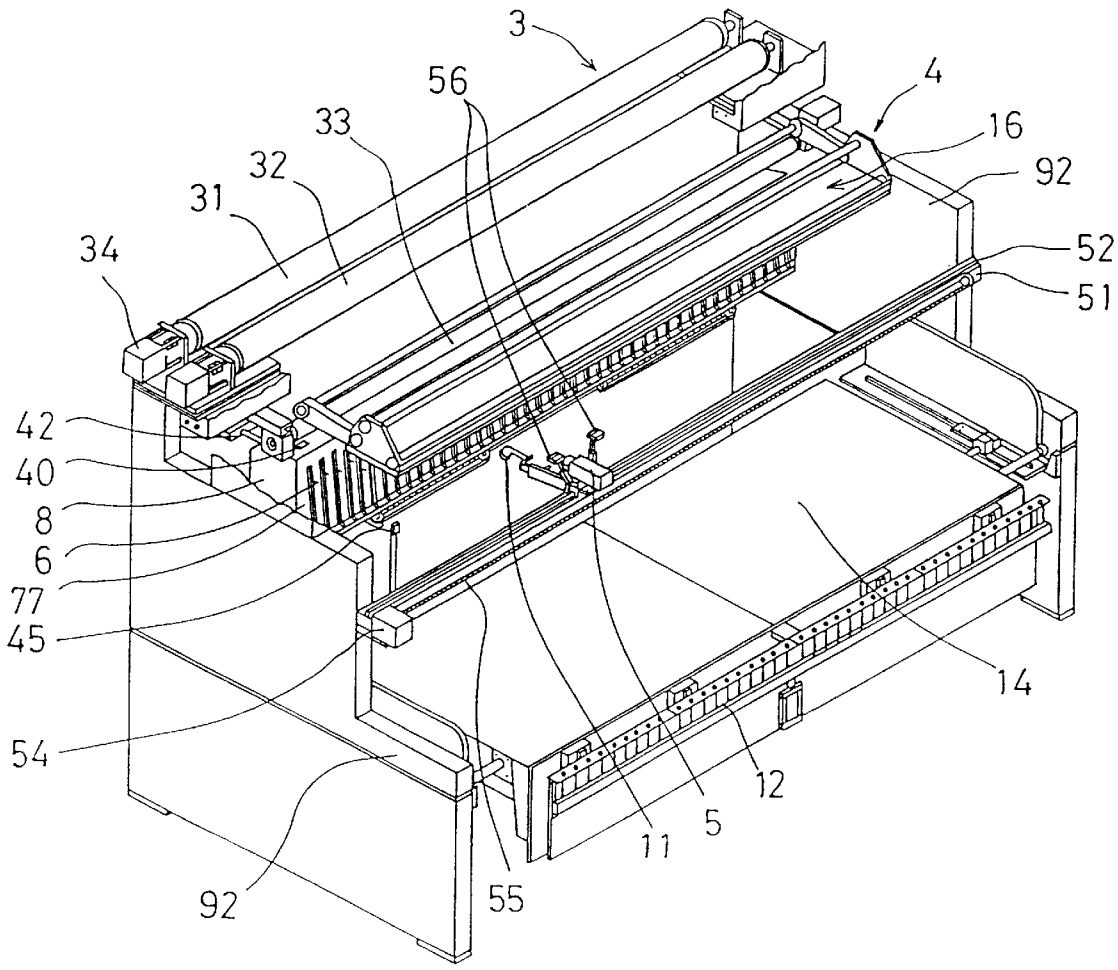
FIG. 1 is a perspective view showing the assembled construction of the equipment to which an automatic fabric pattern-matching apparatus according to an embodiment of the present invention is applied.
Figure 2:
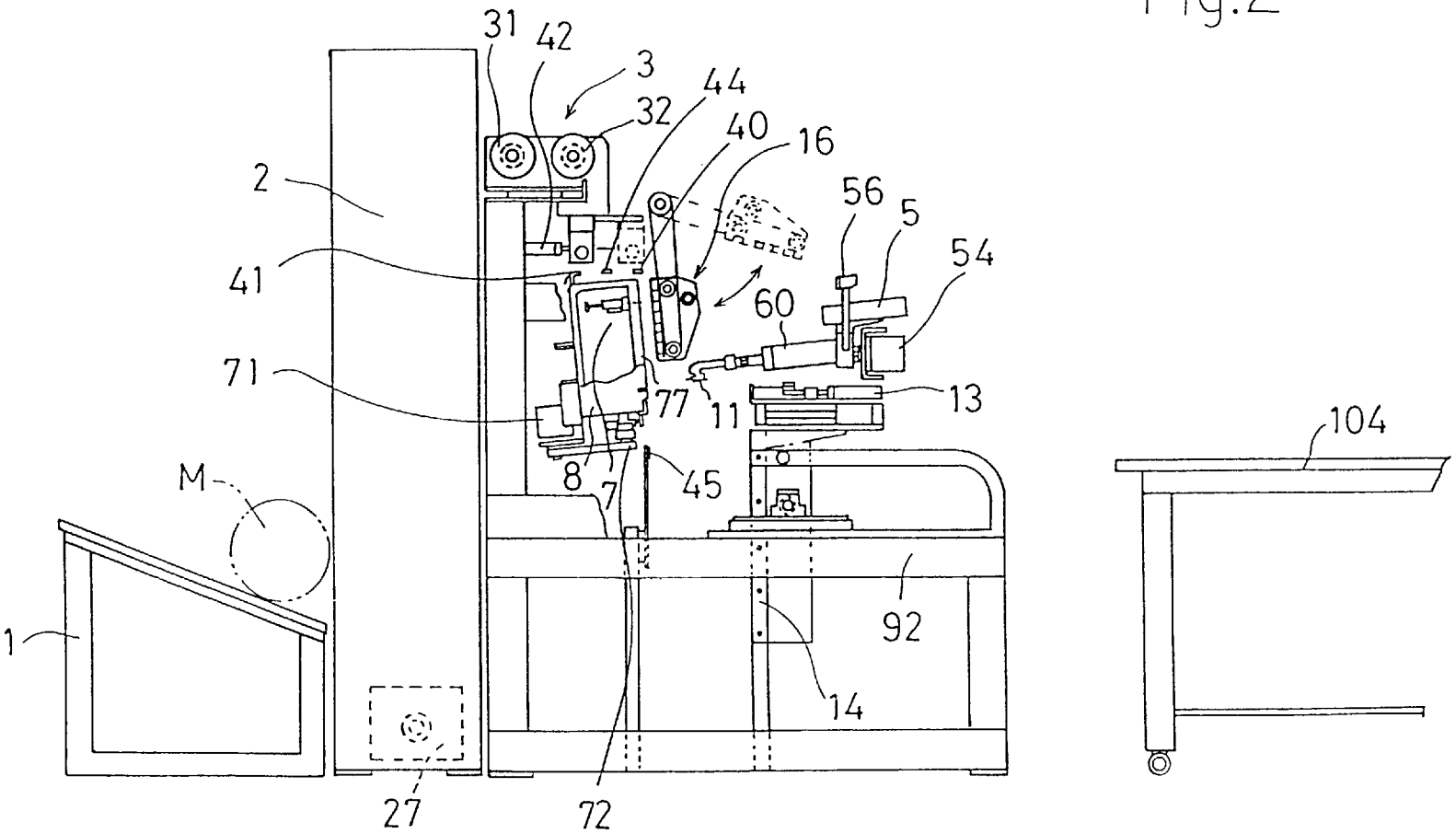
FIG. 2 is a side view showing the assembled construction of the equipment shown in FIG. 1.
Figure 3:
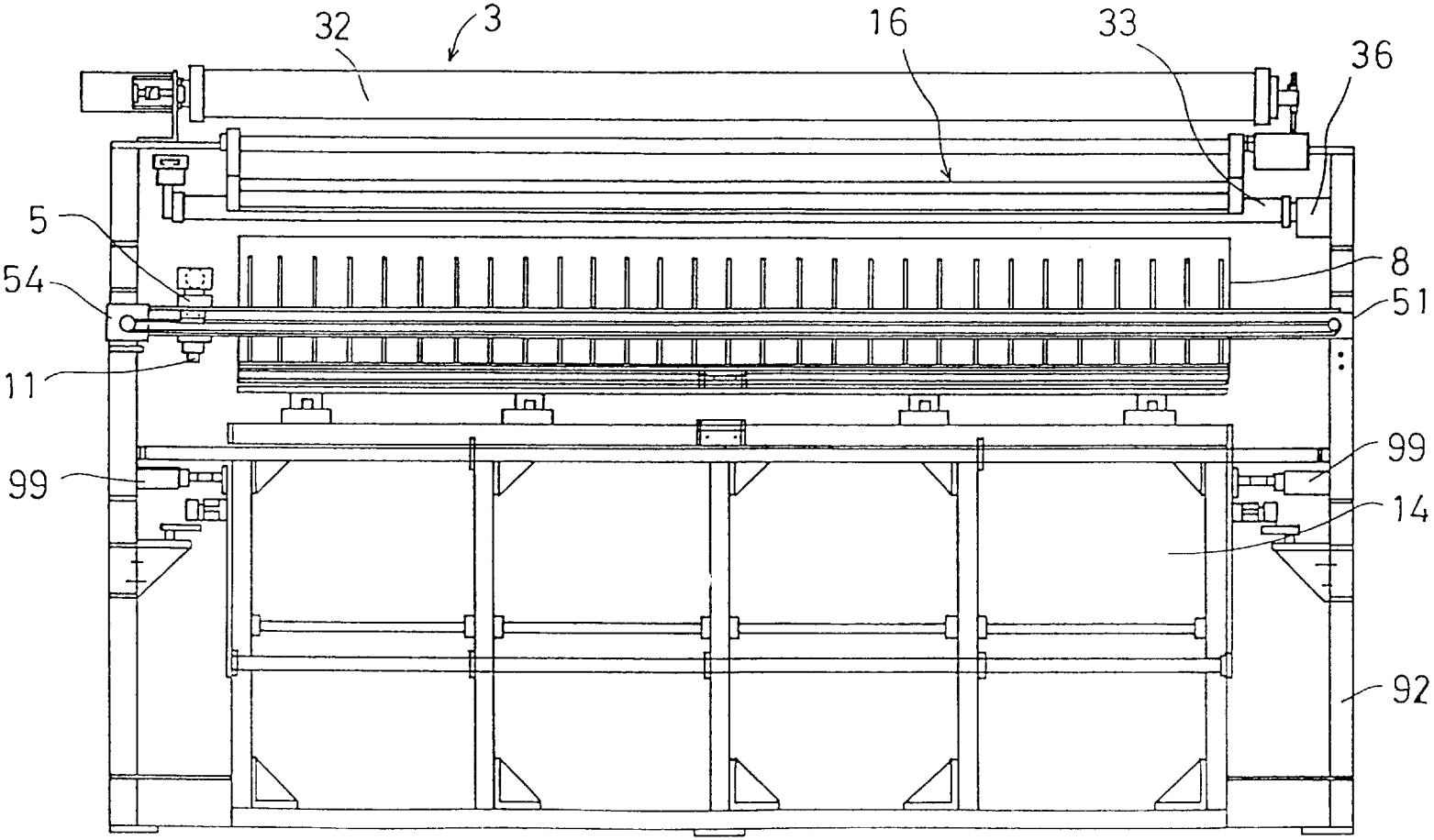
FIG. 3 is a front view showing the assembled construction of the equipment shown in FIG. 1.

FIG. 1, FIG. 2, and FIG. 3 are a perspective view, a side view, and a front view, respectively, of the assembled construction of the equipment to which an automatic fabric pattern-matching apparatus according to an embodiment of the present invention is applied. As shown in FIGS. 1 to 3, the equipment comprises in the order starting from the front side: a table 1 for a wound fabric M obtained by winding a fabric MA, is placed and set; a wound fabric elevator 2 for elevating the wound fabric M placed on the wound fabric table 1 vertically upward so as to transport it to an unwinding position; an automatic fabric unwinding device 3 for unwinding the wound fabric M at the unwinding position and for spreading it over a predetermined size, i.e., to a predetermined extent; a fabric feeding mechanism 4 for feeding the spread fabric MA into a hanging state; an optical reading means, e.g., a CCD camera 5 disposed so as to oppose, or be adjacent to the front face of the hanging portion of the fabric MA; a pattern matching unit box 8, disposed on the back side of the fabric so as to oppose the back face of the hanging portion of the fabric MA, for accommodating a plurality of pattern matching units 7 each of which comprises a pattern matching needle 6 for positioning the pattern and is movable in the backward, forward and vertical directions; a rotary cutter 11 which functions as a cutting device for cutting the fabric MA which has been subjected to pattern matching; a receiving table 14 which comprises fabric receiving needles 12 for receiving the cut fabric MA, an air cylinder 13 for moving the fabric receiving needles 12 backward and forward, etc.; a receiving table driving mechanism 15; and a fabric pressing device 16 disposed at a position opposing the front face of the hanging portion of the fabric M.

Figure 4:
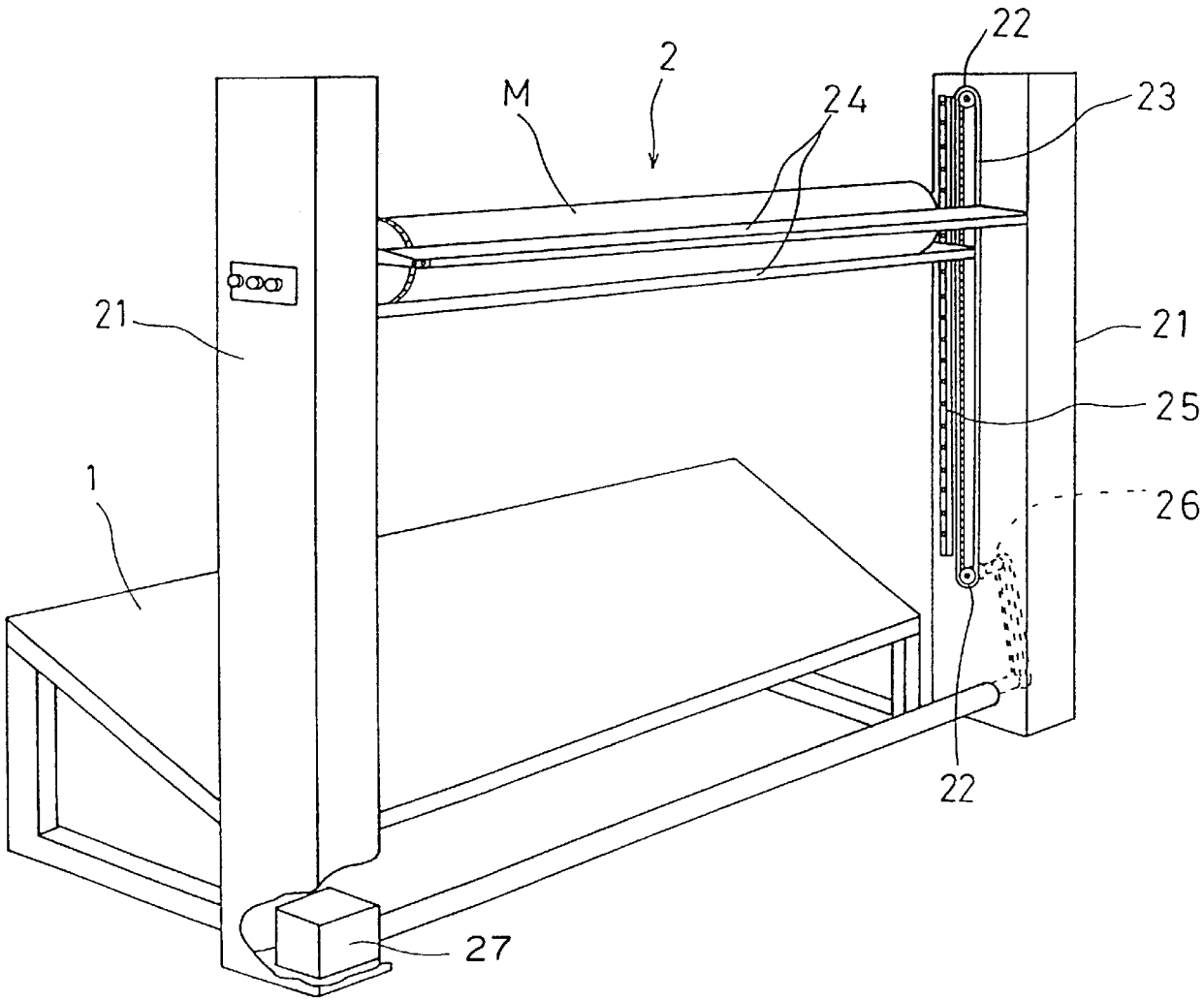
FIG. 4 is a perspective view of a wound fabric elevator.

As shown in FIG. 4, in the wound fabric elevator 2, sprockets 22 . . . are rotatably attached in upper and lower portions of opposing faces of a pair of right and left upright frames 21, 21 (the sprockets on the left frame are not shown). On the sprockets 22 . . . , loop chains 23, 23 are wound, and both ends of a plurality of wound fabric elevating plates 24 . . . are fixedly attached to the loop chains 23, 23. These wound fabric elevating plates 24 . . . are elevated and guided along rails 25, 25 which are formed on the opposing faces of the pair of upright frames 21, 21. The pairs of right and left sprockets 22, 22 are fixed via shafts 26, and are coupled with a motor 27 which is located at the bottom of the left upright frame 21. The loop chains 23, 23 are rotated by the motor 27 so that the wound fabric elevating plates 24 . . . are reciprocatingly moved upward and downward. In the configuration, as shown in FIG. 2, each wound fabric M which is placed on the wound fabric table 1 is automatically elevated by the wound fabric elevator 2 one by one. When one of the elevated wound fabrics M reaches the upper end, it is rolled and transferred to the unwinding position.

Figure 5:
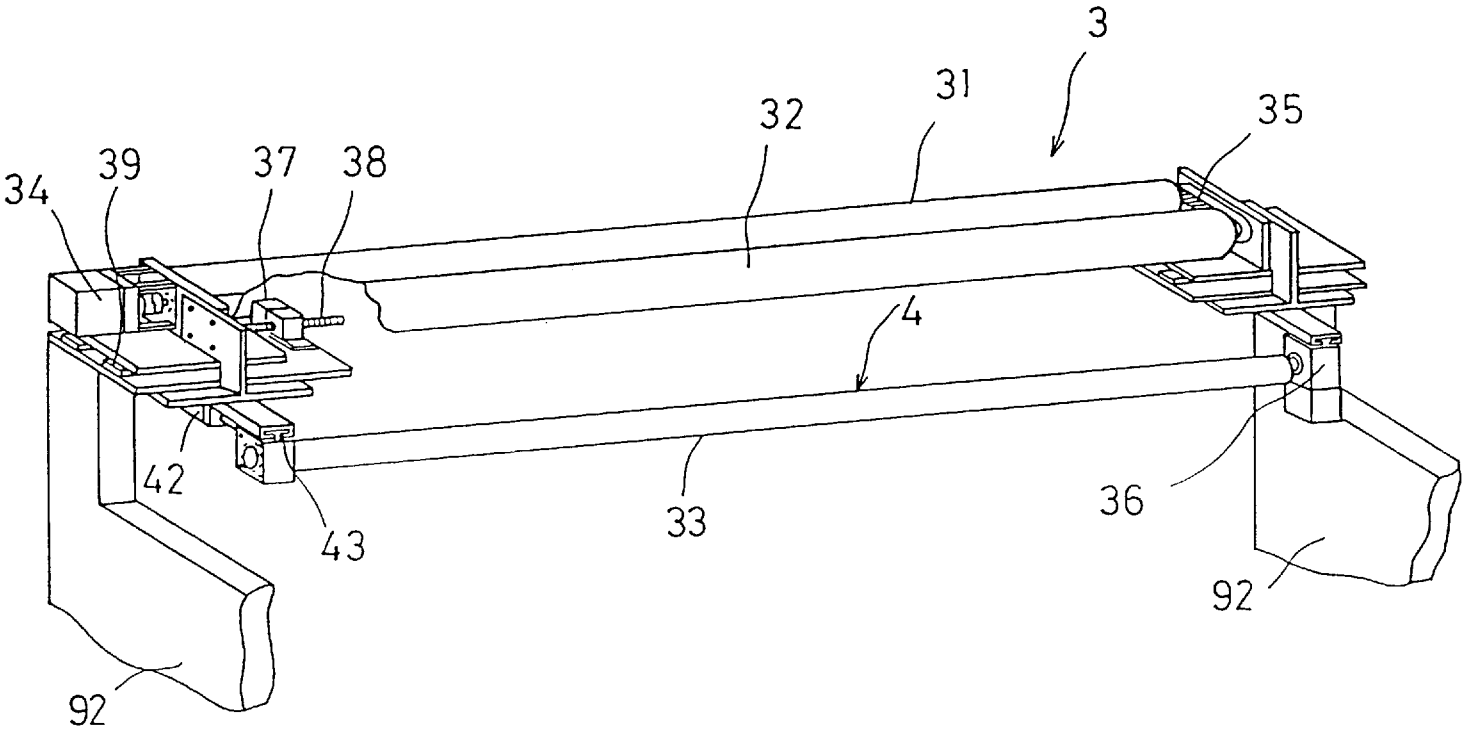
FIG. 5 is a partially cutaway perspective view showing a driving unit of an automatic fabric unwinding device.

As shown in FIG. 5, the automatic fabric unwinding device 3 comprises first and second unwinding rollers 31, 32, and an auxiliary roller 33 which constitutes a part of the fabric feeding mechanism 4. The first and second unwinding rollers 31, 32 can be rotated by a motor 34 and a belt 35 in forward and reverse directions, and the auxiliary roller 33 can be rotated by a motor 36 in forward and reverse directions. The first and second unwinding rollers 31, 32 and the auxiliary roller 33 can be moved in the right and left directions or laterally along rails 39 for lateral motion via a motor 37 for lateral motion and a ball screw 38 which is moved together with the motor 37, based on an edge detection signal for the fabric MA and produced by an edge detection sensor 40 (see FIG. 2). Due to the lateral motion, the edge of the fabric MA is arranged properly.

Furthermore, a fabric lower end position detection sensor 41 (see FIG. 2 and FIGS. 6 to 8) for detecting the lower end position of the fabric MA unwound by the clockwise rotation of the first and second unwinding rollers 31 and 32 is provided. The auxiliary roller 33 can be moved forward along rails 43 for backward and forward motion via a cylinder 42 for backward and forward motion of the auxiliary roller 33, based on a detection signal of the fabric lower end position detection sensor 41. A deflection detection sensor 44 (see FIG. 2 and FIG. 7) is provided to detect whether the slack amount of the fabric MA which is slacked in a substantially U-shape between the forward-moved auxiliary roller 33 and the second unwinding roller 32 reaches a predetermined amount or not. These two sensors 41 and 44, the auxiliary roller 33, etc. constitute the fabric feeding mechanism 4. In addition, the reference numeral 45 designates a fabric size control sensor for detecting the lower end M*a* of the fabric MA.

Figure 6:
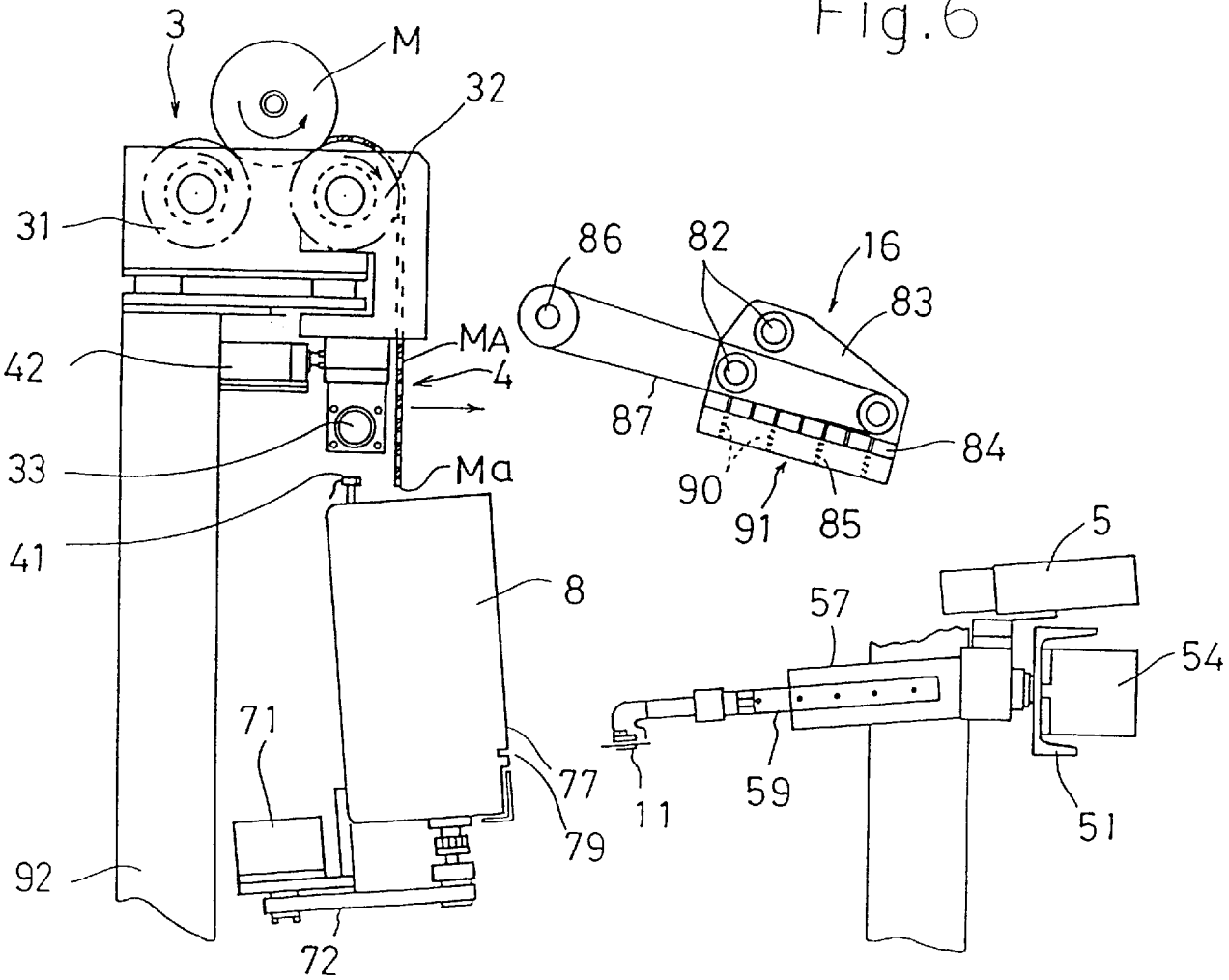
FIG. 6 is an enlarged side view of main portions of the automatic fabric pattern-matching apparatus and showing a first step of an operation from the unwinding to the reading of patterns conducted by the automatic fabric unwinding device.
Figure 7:
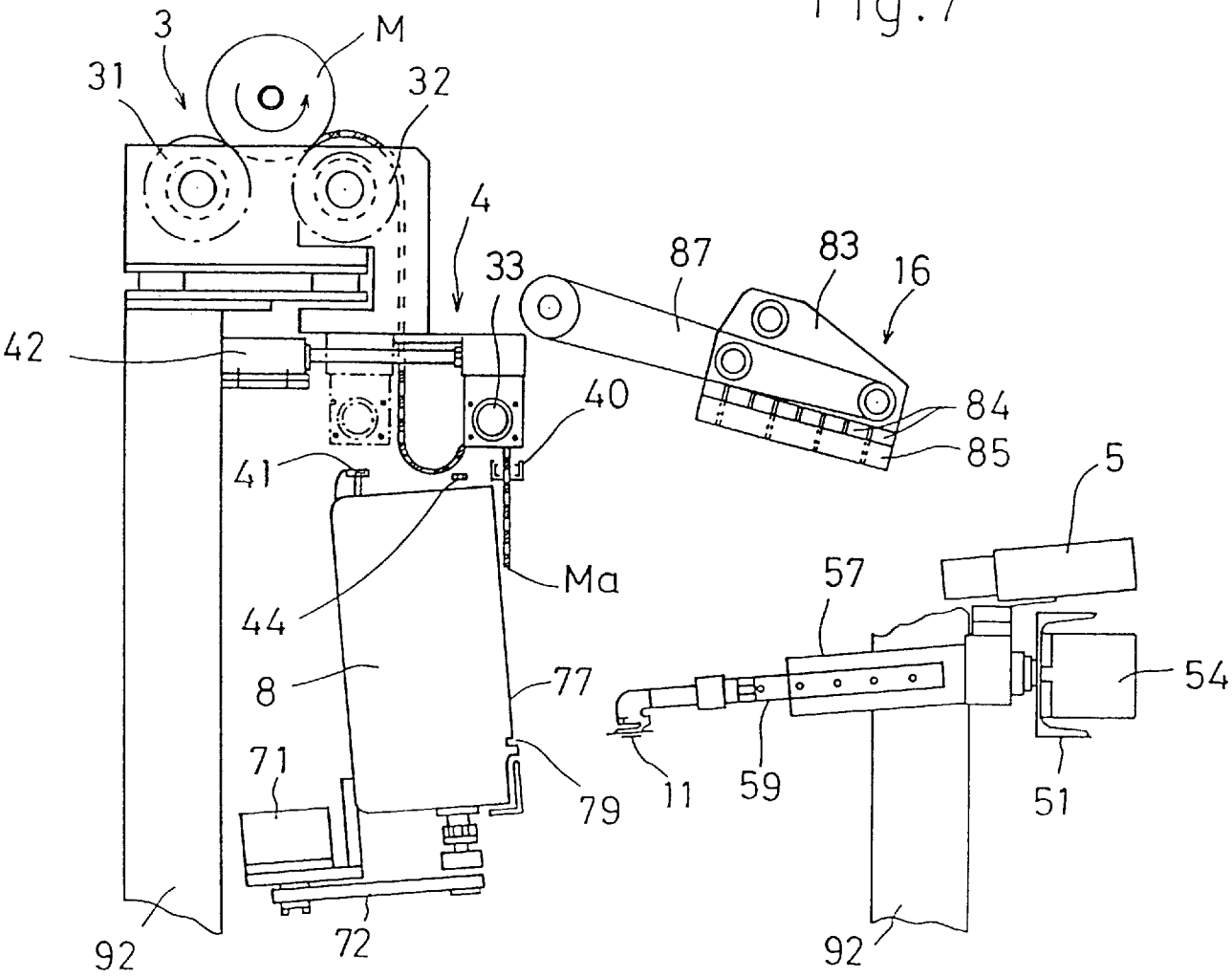
FIG. 7 is an enlarged side view of main portions of the automatic fabric pattern-matching apparatus and showing a second step in the operation from the unwinding to the reading of patterns by the automatic fabric unwinding device.

The operation of unwinding the wound fabric M by the automatic fabric unwinding device 3 having the above-described construction will be described with reference to the operational views of FIGS. 6 to 8 and the flowchart of FIG. 9.

First, by rotating the first and second unwinding rollers 31, 32 in a clockwise direction, the wound fabric M transported to the unwinding position is rolled in a counterclockwise direction. The wound fabric M is unwound over a predetermined size, and, as shown in FIG. 6, the fabric termination (winding end portion) M*a* of the wound fabric M is hung below the second unwinding roller 32. At this time, the lower end portion M*a* of the fabric MA is detected by the fabric lower end position detection sensor 41 (step R1). On the basis of the detection signal of the fabric lower end position detection sensor 41, the cylinder 42 for backward and forward motion of the auxiliary roller 33 is activated so that the auxiliary roller 33 is moved forward along the rails 43 (step R2). Accordingly, as shown in FIG. 7, the fabric MA is slacked to form a substantially U-shape between the auxiliary roller 33 and the second unwinding roller 32. The deflection detection sensor 44 detects whether the slack amount reaches a predetermined amount or not. Until the slack amount reaches the predetermined amount, the rotation of the first and second unwinding rollers 31, 32 in the clockwise direction is maintained, so that the slack amount is controlled (steps R3 and R4).

When the slack amount of the fabric MA reaches the predetermined amount, the auxiliary roller 33 starts to rotate, so that the fabric MA is lowered to a predetermined position (step R5). At this time, the edge of the fabric MA is detected by the edge detection sensor 40. If there is a deviation in the width direction of the fabric MA, the first and second unwinding rollers 31, 32, and the auxiliary roller 33 are moved based on an edge detection signal of the edge detection sensor 40 along the rails 39 for lateral motion to the right or left or lateral directions by the motor 37 for lateral motion and the ball screw 38 which is moved together with the motor 37. As a result of this lateral motion, the edge of the fabric MA is arranged properly (step R6). The lower end portion M*a* of the fabric MA is detected by the fabric size control sensor 45. When the lower end portion M*a* of the fabric MA is lowered to the predetermined position as shown in FIG. 8, the rotation of the rollers 31, 32, and 33 is stopped, and the feeding of the fabric MA is stopped (steps R7 to R9).

Figure 10:
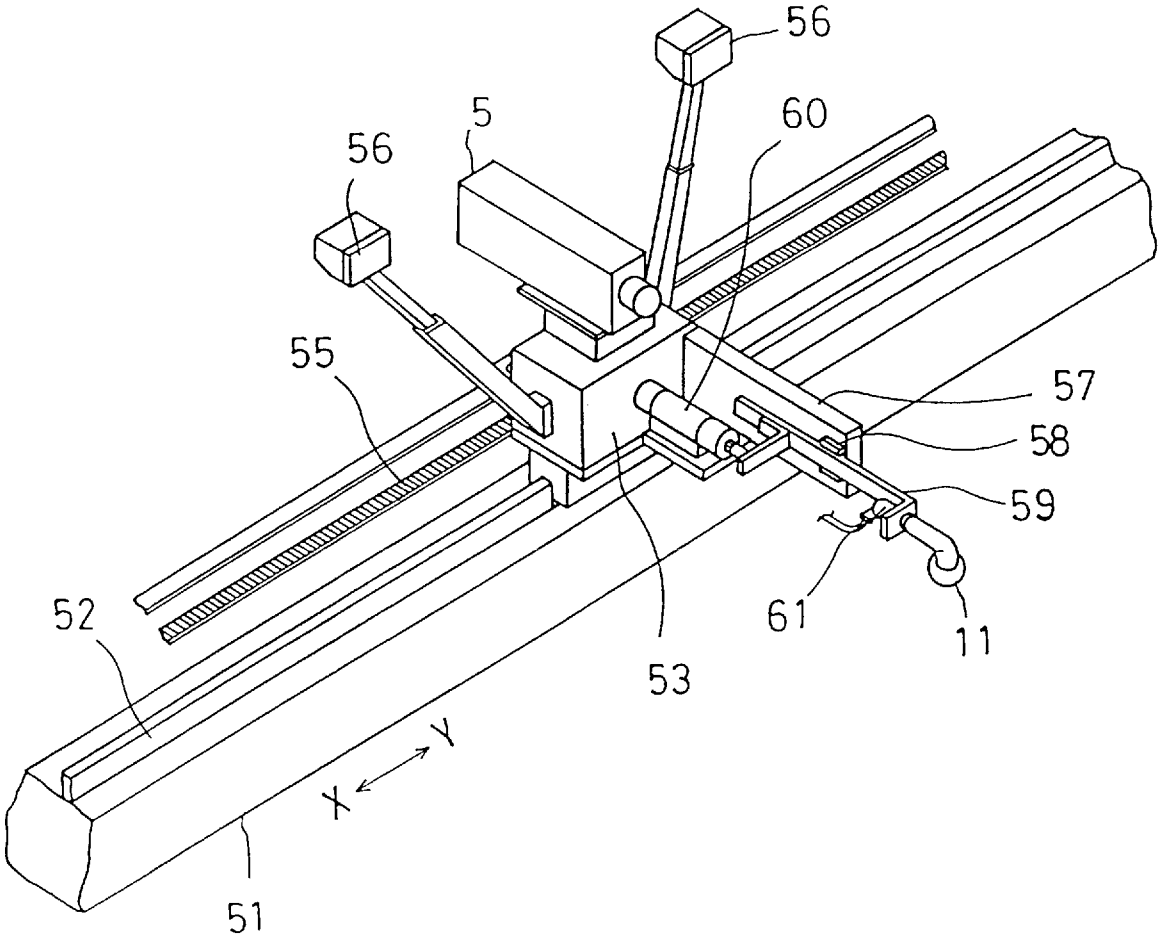
FIG. 10 is a perspective view showing a rotary cutter and a driving unit of a CCD camera.

The CCD camera 5 can be driven and moved in the lateral directions (X, Y) along a rail 52 of a fixed frame 51 shown in FIG. 1. That is, as shown in FIG. 10, a platform 53 for the CCD camera 5 is coupled with a belt 55 which is driven by a motor 54. The reference numeral 56 designates a light for tight close-up illumination and attached to the platform 53. The CCD camera 5 reads the difference in color and the color gradation, and outputs the read result as an electric signal to a control device (microcomputer) which is not shown.

A supporting arm 57 for the rotary cutter 11 extends integrally from the platform 53. A cutter arm 59 which is supported so as to be slidable backward and forward by the arm 57 via a slider 58 is freely driven and moved backward and forward via an air cylinder 60. In addition, an air motor 61 for driving the rotary cutter 11 is fixedly held by a tip portion of the cutter arm 59.

Figure 11:
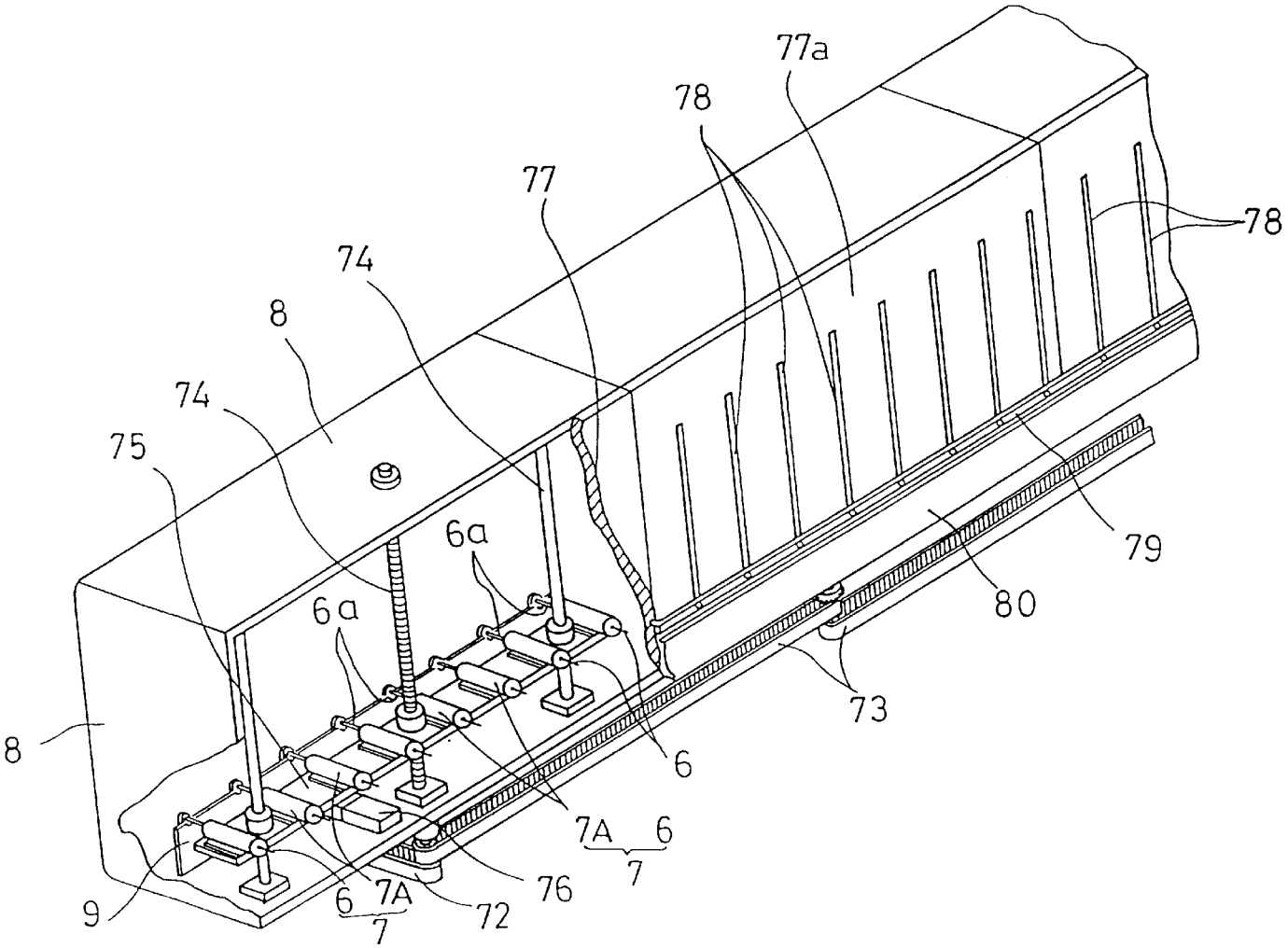
FIG. 11 is a partially cutaway enlarged perspective view showing a pattern matching unit box and a pattern matching unit driving unit.
Figure 12:
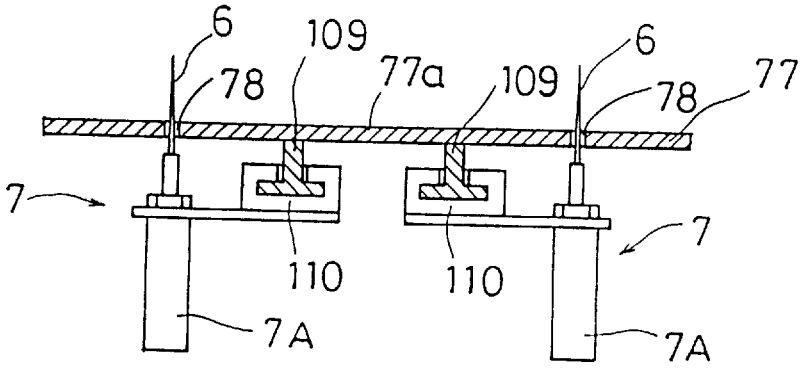
FIG. 12 is an enlarged plan view of main portions of the pattern matching unit.

The pattern-matching unit box 8 and the pattern matching units 7 are constructed in the following manner. Referring to FIG. 11, in the unit box 8, a plurality of ball screws 74 which are rotated by a motor 71 via belts 72, 73 are provided in a longitudinally standing manner at appropriate intervals in a lateral width direction. On a unit elevating plate 75 which is fittingly supported in a movable manner in the axial direction, i.e., the vertical direction in accordance with the rotation of these ball screws 74, the plurality of pattern matching units 7 are separably mounted and supported at regular intervals in the lateral width direction of the unit elevating plate 75. These pattern matching units 7 comprise solenoids 7A which are individually disposed, and the above-mentioned pattern matching needles 6 each of which is individually pushed to be moved forward in accordance with the attractive operation of the corresponding solenoid 7A. As shown in FIG. 12, each of the solenoids 7A is fixed on an inner face of the front plate of the unit box 8, so as to be movable only in the vertical direction via a T-shaped guide 109 and a slider 110 which is slidably fitted onto the guide. After pattern matching, the plurality of pattern matching units 7 are simultaneously moved and returned to the rear predetermined positions, by moving backward via an air cylinder 76 a supporting plate 9 which is engaged with grooves of base end portions 6*a* of the pattern matching needles 6 in the plurality of pattern matching units 7 which fall onto the unit elevating plate 75 due to gravity.

The front plate of the unit box 8 is formed as a fabric receiving and supporting plate 77 comprising a slope 77*a* which opposes the back side of the hanging portion of the fabric MA fed in a hanging manner and receives and supports the hanging portion of the fabric MA in an inclined manner in which the lower portion is more displaced backward. The pattern matching needles 6 can respectively be moved backward and forward through slits 78 which are longitudinally elongated and are disposed at regular intervals in the lateral width direction of the fabric receiving and supporting plate 77. The pattern matching units 7 are moved in the longitudinal direction in accordance with the signal from the CCD camera 5, and the pattern matching needles 6 are then inserted so that pattern matching in the horizontal direction of the fabric MA is performed.

In a lower portion of the fabric receiving and supporting plate 77 which is the front plate of the pattern-matching unit box 8, a cutter grooves 79 is formed substantially over its width in the lateral width direction. The rotary cutter 11 is rotated while partially received in the cutter groove 79. Directly under the pattern-matching unit box 8, a fabric drop preventing plate 80 with a width equal to the overall lateral width of the unit box 8 is disposed. The fabric drop preventing plate 80 is constructed in such a manner that it can be moved backward and forward via an air cylinder 81 (see FIG. 19). Furthermore, the slope 77*a* of the fabric receiving and supporting plate 77 has a slope angle of about 85°, so that the ball screws 74 are also tilted at the same angle.

Figure 13:
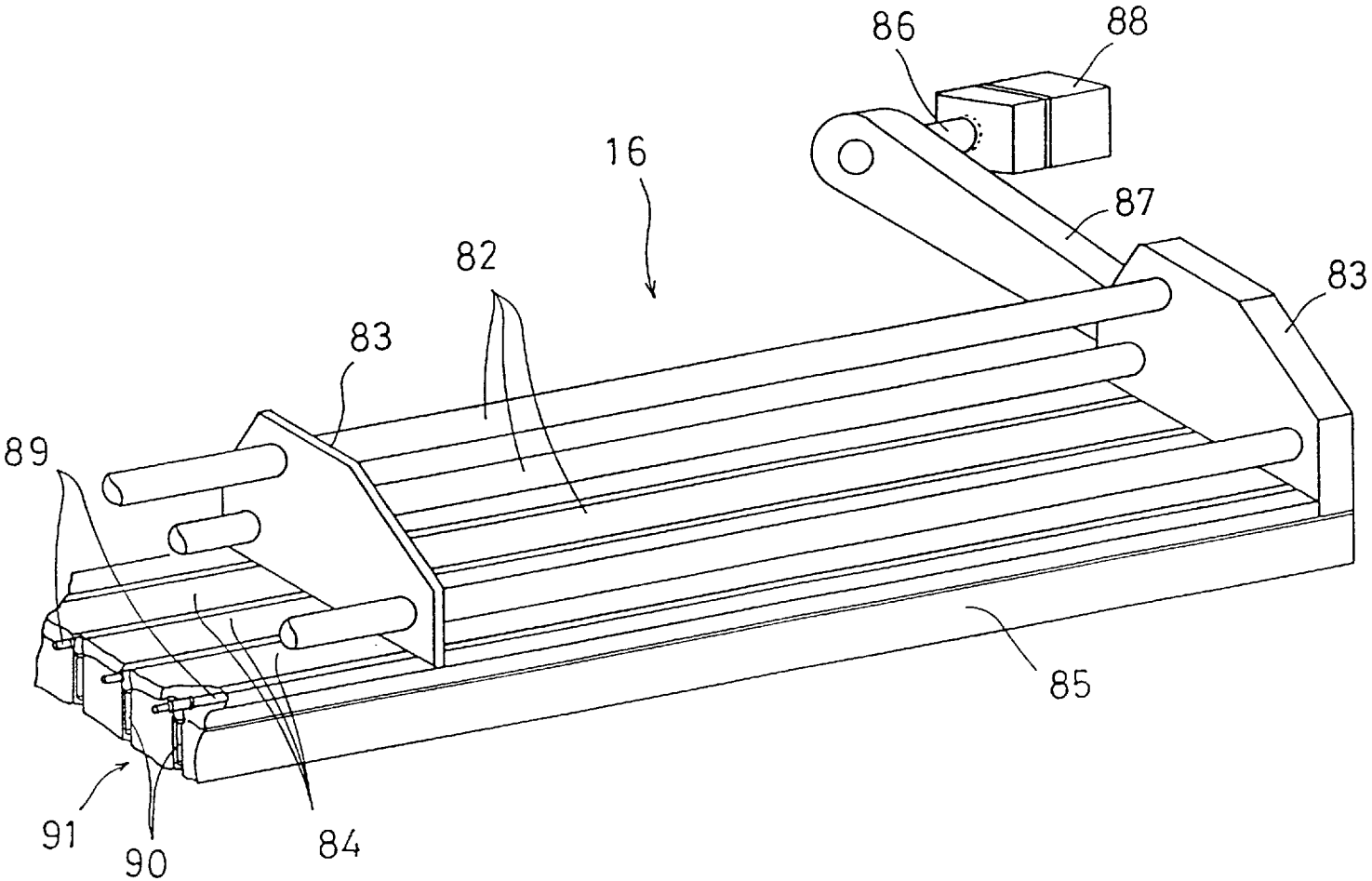
FIG. 13 is a partially cutaway enlarged perspective view showing a driving unit of a fabric presser.

The fabric pressing device 16 is constructed as shown in FIG. 13. Specifically, plate members 83 are fixed to both ends of a plurality of shafts 82, and a thick sponge 85 is adhered to the surface of bridging plates 84 which are laterally provided between the flat portions of the plate members 83 on both ends. The fabric pressing device 16 presses the front side of the hanging portion of the fabric MA which is received along the slope 77*a* of the fabric receiving and supporting plate 77, against the slope 77*a*. The fabric pressing device 16 is fixed to a tip end portion of a rotary arm 87 which can be rotated via a rotating cylinder 88 about a shaft 86 which is set above the fabric pressing position. Air hoses 89 are disposed between adjacent ones of the bridging plates 84, respectively. An air blowing device 91 is constructed in such a manner that air nozzles 90 protruded from and communicating with the air hoses 89 are passed through the sponge 85 in the thickness direction thereof at a plurality of positions, and are opened on the surface of the sponge 85. The air blowing device 91 blows air to the hanging portion of the fabric MA when the fabric pressing device 16 is rotated and moved in a pressure release direction.

Figure 14:
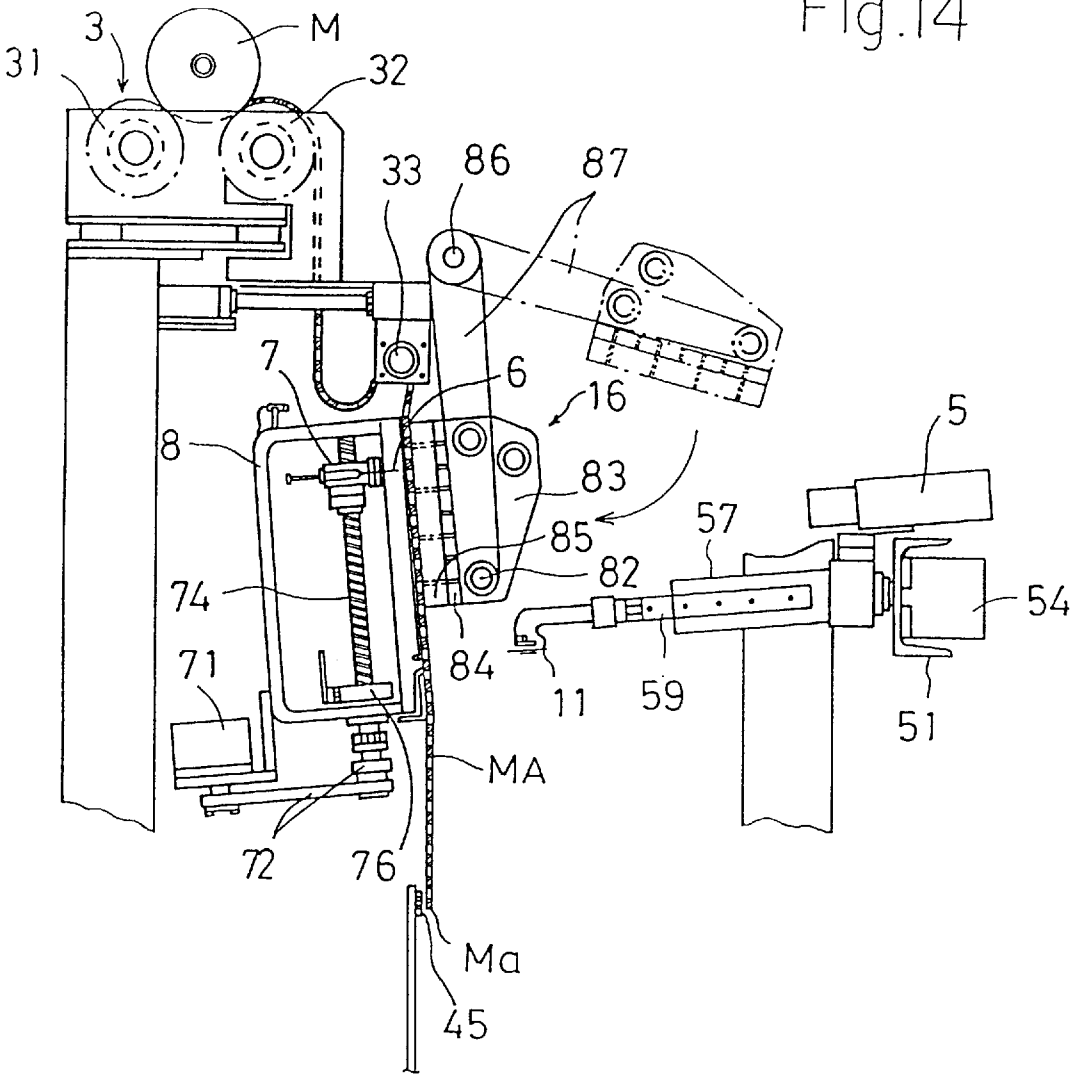
FIG. 14 is an enlarged side view of main portions of the pattern matching unit box and of the fabric presser and showing a first step of a pattern reading operation.

The pattern matching process conducted on the fabric MA by the cooperative operation of the CCD camera 5 and the pattern matching needles 6 after the end portion of the fabric MA is fed in the hanging manner by the fabric feeding mechanism 4 will be described with reference to the operational views of FIGS. 14 to 16 and the flowchart of FIG. 17.

Figure 8:
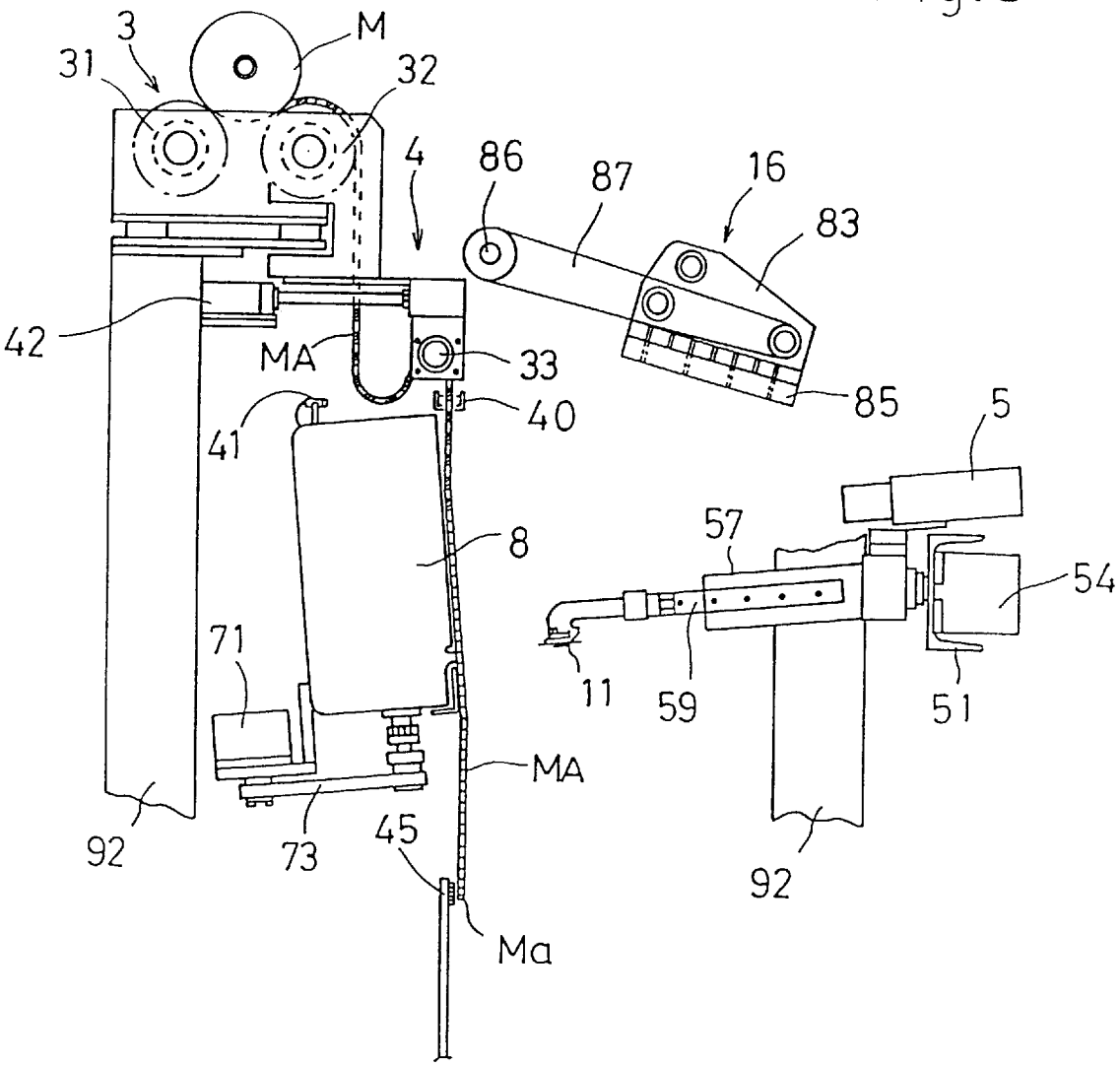
FIG. 8 is an enlarged side view of main portions of the automatic fabric pattern-matching apparatus and showing a third step in the operation from the unwinding to the reading of patterns by the automatic fabric unwinding device.
Figure 9:
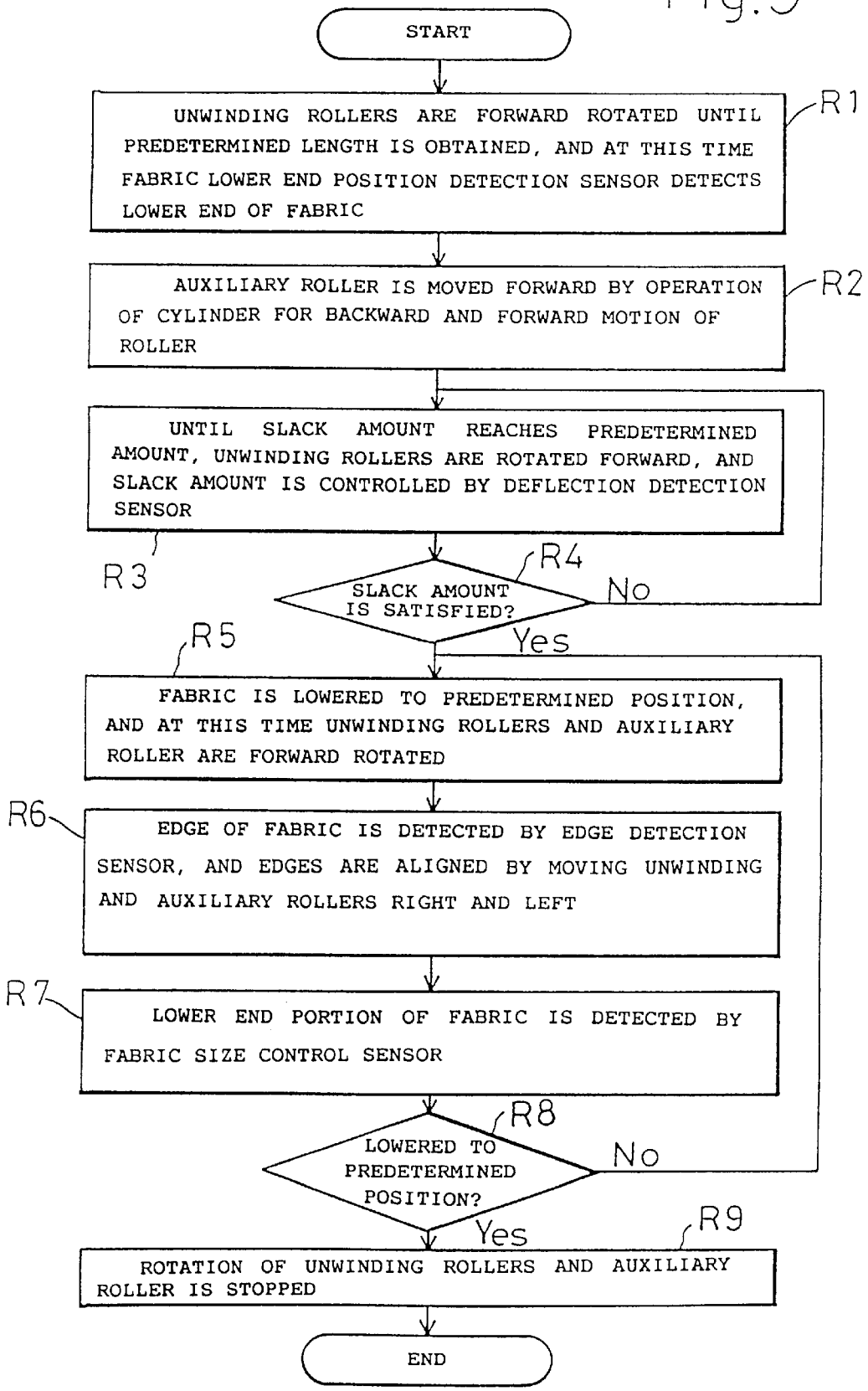
FIG. 9 is a flowchart illustrating the operation from the unwinding to the reading of patterns.

First, in the condition shown in FIG. 8, the motor 54 is driven to laterally move the CCD camera 5 along the rail 52, so that the CCD camera 5 reads the pattern of the fabric MA (step N1). After the CCD camera 5 reads the pattern (step N2), the forward push-out timing instructions for the pattern matching needles 6 are fed to the solenoids 7A of the respective pattern matching units 7 based on the read result. Next, the fabric pressing device 16 is rotated and moved downward about the shaft 86 via the rotating cylinder 88, so that the front side of the hanging portion of the fabric MA which is received along the slope 77*a* of the fabric receiving and supporting plate 77 is pressed against the slope 77*a* (step N3). At this time, the hanging portion of the fabric MA is received and supported in the inclined manner along the slope 77*a* of the receiving and supporting plate 77, and furthermore its front side is pressed by the sponge 85 of the fabric pressing device 16. Accordingly, even if the hanging portion of the fabric MA is curved or deformed in a wave manner, or includes creases, it can be corrected into a flat state and stably supported.

Figure 15:
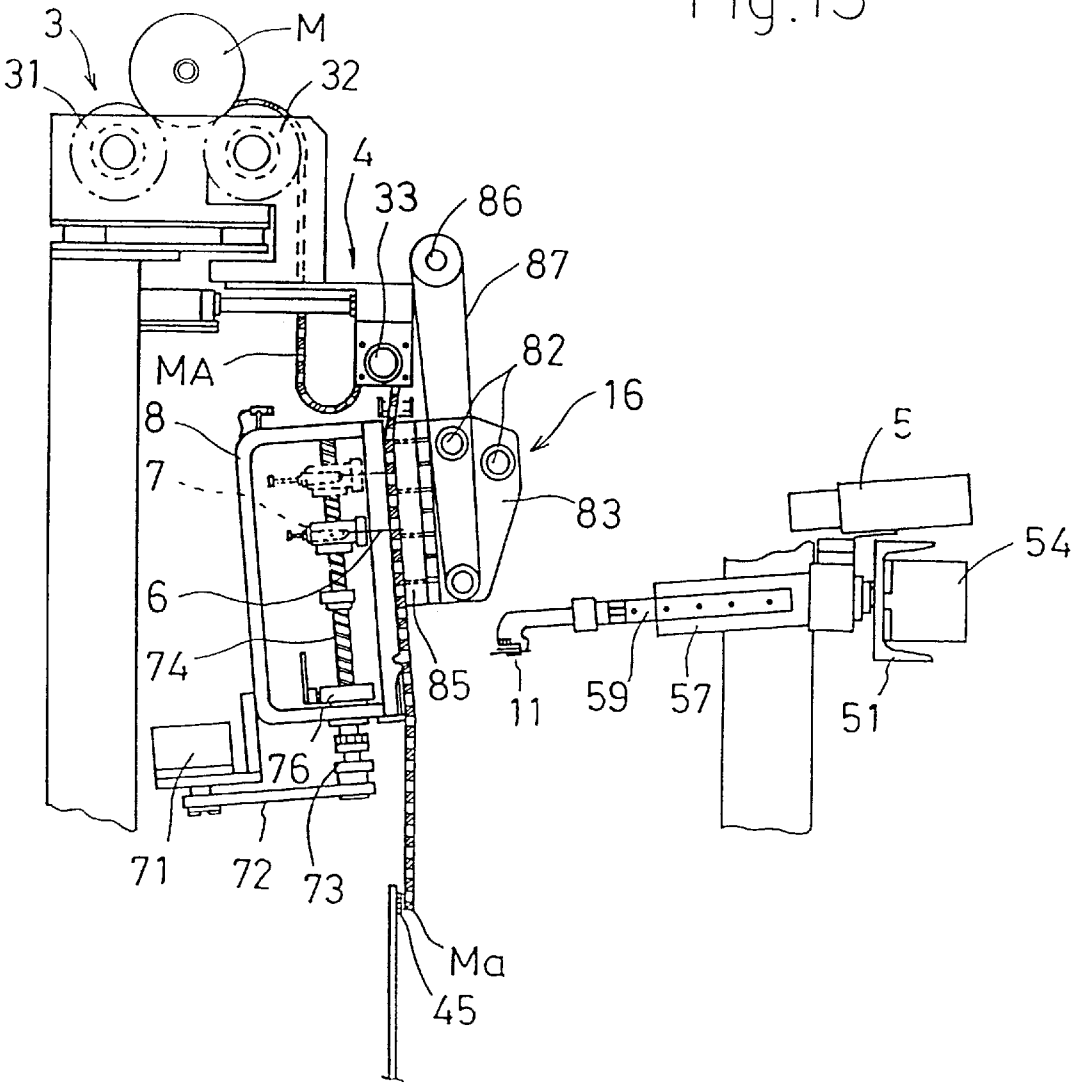
FIG. 15 is an enlarged side view of main portions of the pattern matching unit box and of the fabric presser and showing a second step of the pattern reading operation.

Next, the pattern matching units 7 are moved downward as shown in FIG. 15 by the motor 71, the belts 72, 73, the ball screws 74, and the unit elevating plate 75, based on the pattern read result of the CCD camera 5. During this downward motion, the respective solenoids 7A are operated due to the timing; instruction, to the solenoids 7A of the respective pattern matching units 7. As a result, the pattern matching needles 6 in the respective pattern matching units 7 are pushed and moved forward through the slits 78, and, as shown in FIG. 15, the needles are inserted at predetermined positions of the lateral stripe pattern of the fabric MA (steps N4 and N5), and also inserted into the sponge 85 of the fabric pressing device 16, so that the needles 6 and the solenoids 7A remain at these positions.

Figure 16:
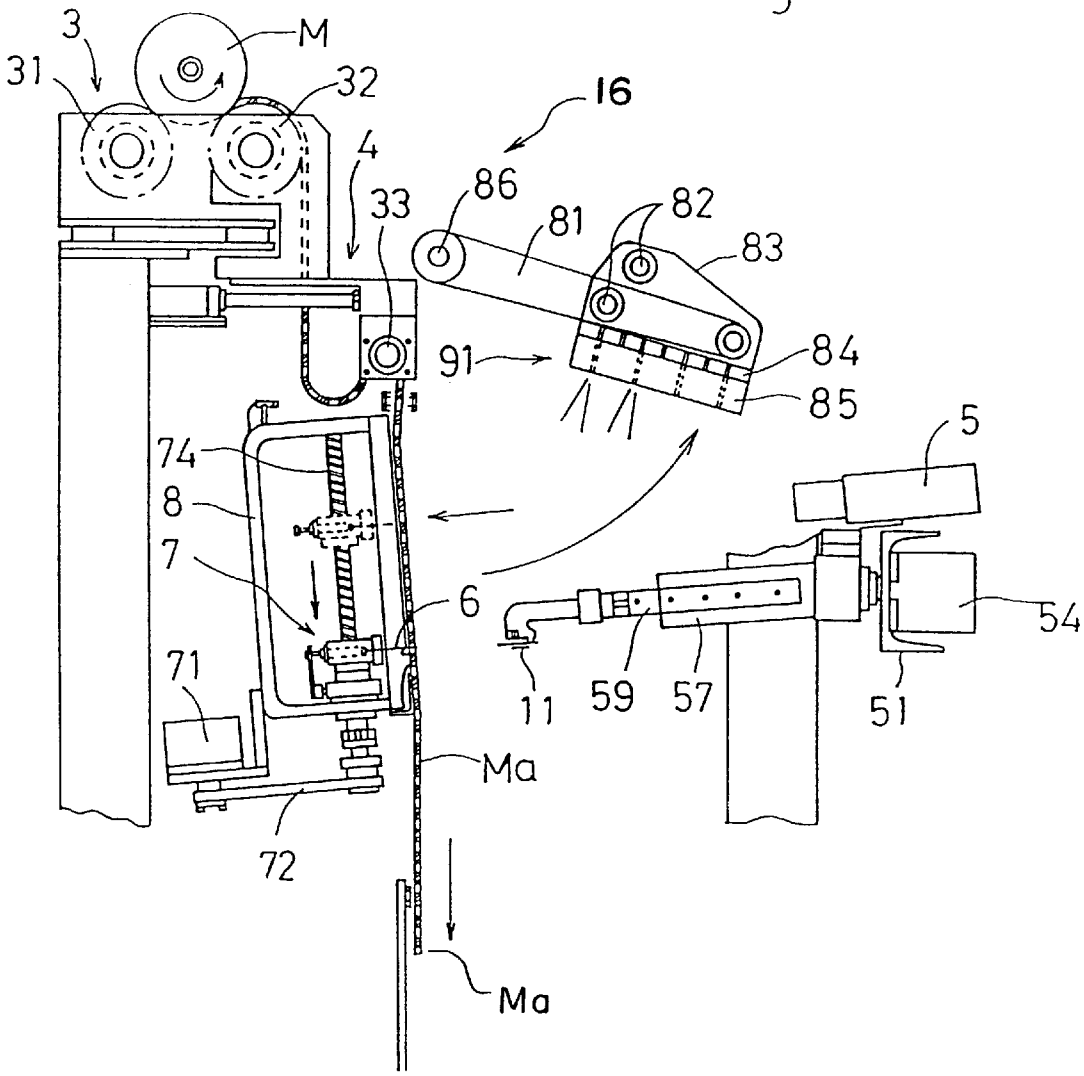
FIG. 16 is an enlarged side view of main portions of the pattern matching unit box and the fabric presser and showing a third step of the pattern reading operation.
Figure 17:
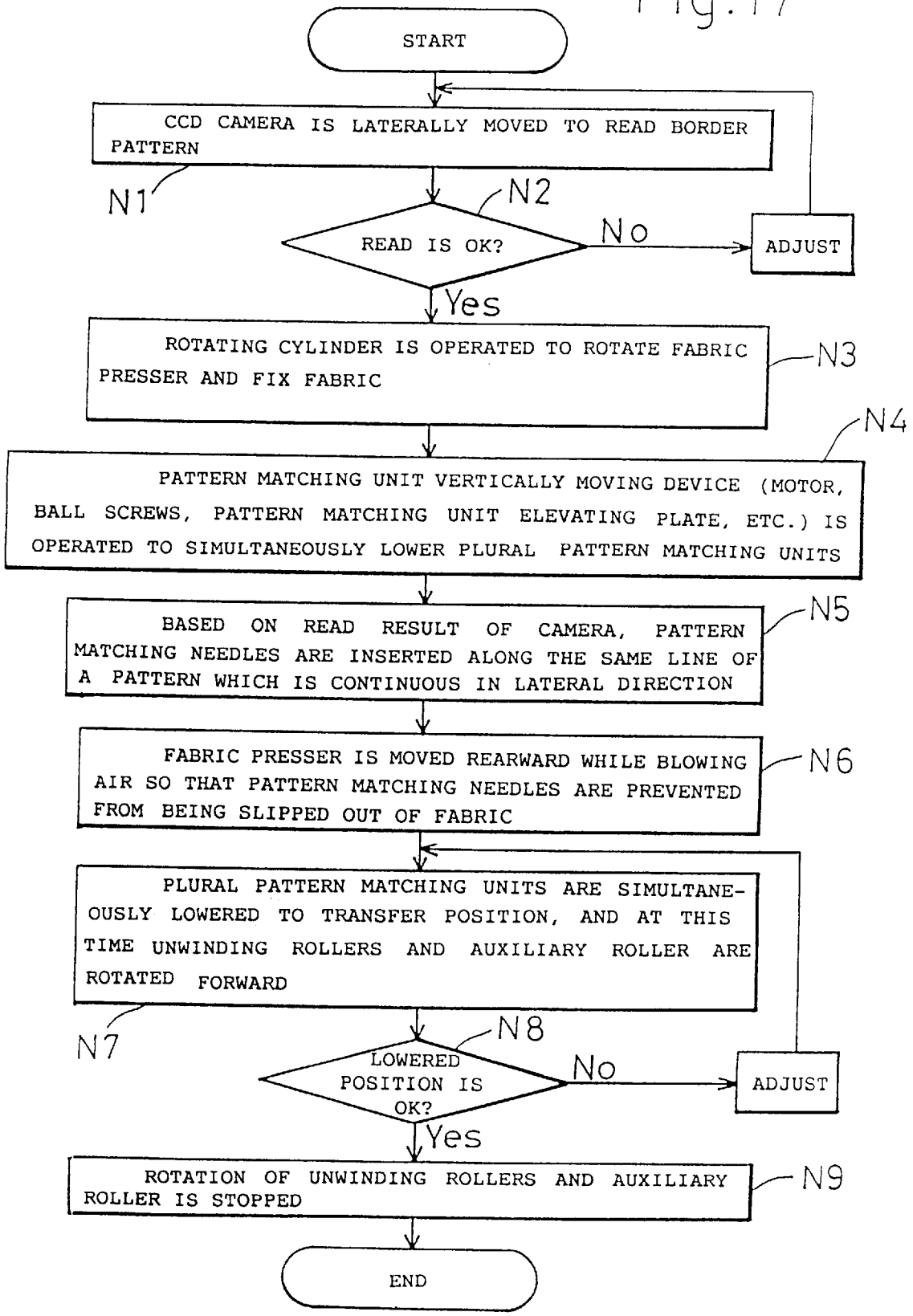
FIG. 17 is a flowchart illustrating the operation in FIGS. 14 to 16.

From this condition, the fabric pressing device 16 is rotated and moved upward about the shaft 86 via the rotating cylinder 88 so as to produce separation as indicated by an arrow shown in FIG. 16. In this process air from the air nozzles 90 of the air blowing device 91, is blown toward the hanging portion of the fabric MA so that the pattern matching needles 6 are prevented from slipping out of the fabric MA. Accordingly, the fabric MA is completely pierced by the pattern matching needle 6 (step N6). At the same time, the plurality of pattern matching units 7 are simultaneously moved downward due to gravity so that they are positioned in a lateral straight line on the lowered elevating plate 75. In order to perform the lowering motion, the clockwise rotation of the unwinding rollers 31, 32 and the auxiliary roller 33 is started (step N7). Then, it is judged whether the fabric MA is lowered to the predetermined position or not (step N8). If the fabric MA reaches the predetermined lowered position, the rotation of the unwinding rollers 31, 32 and the auxiliary roller 33 is stopped (step N9).

Figure 18:
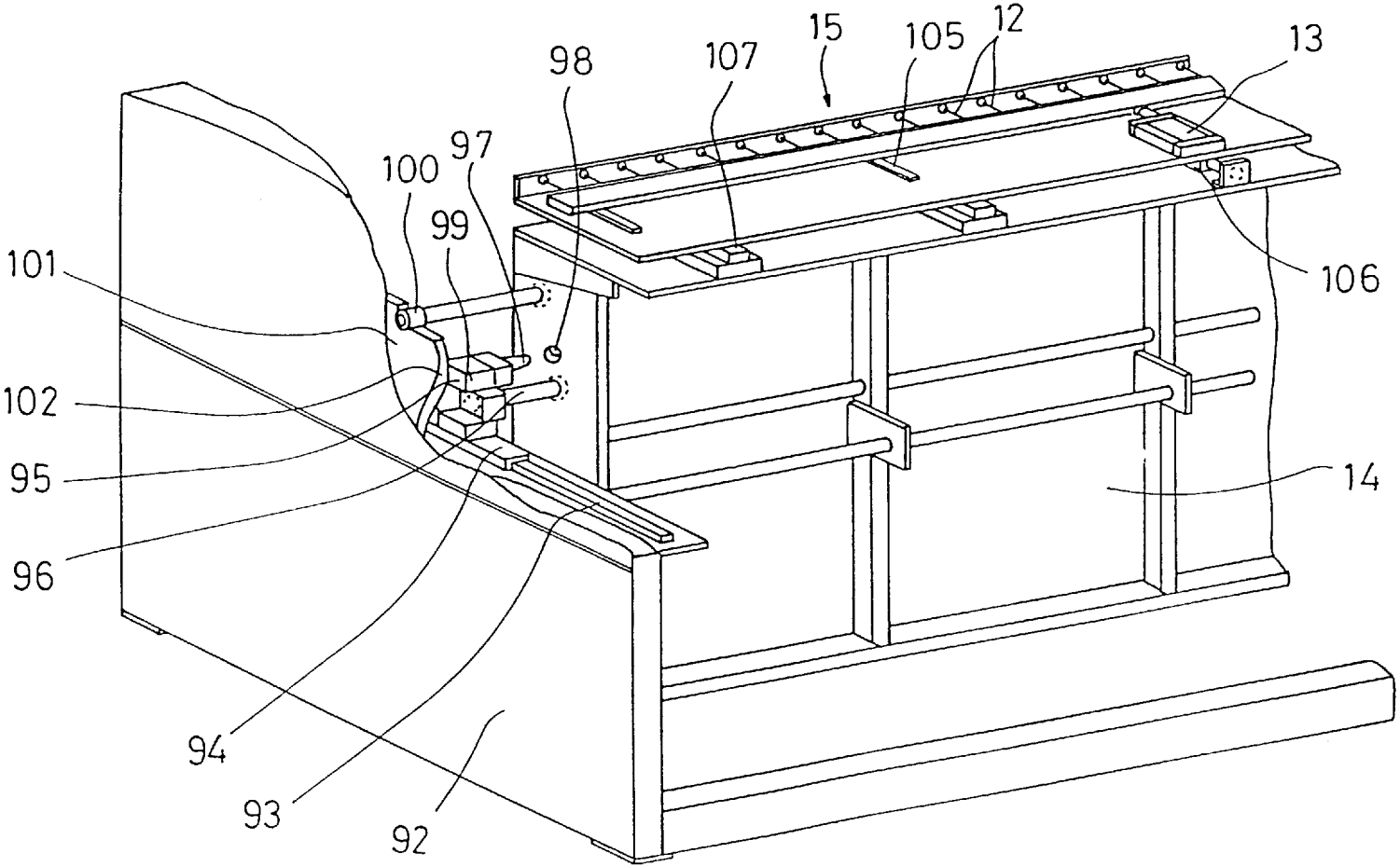
FIG. 18 is a partially cutaway enlarged perspective view showing a supporting plate driving unit.
Figure 19:
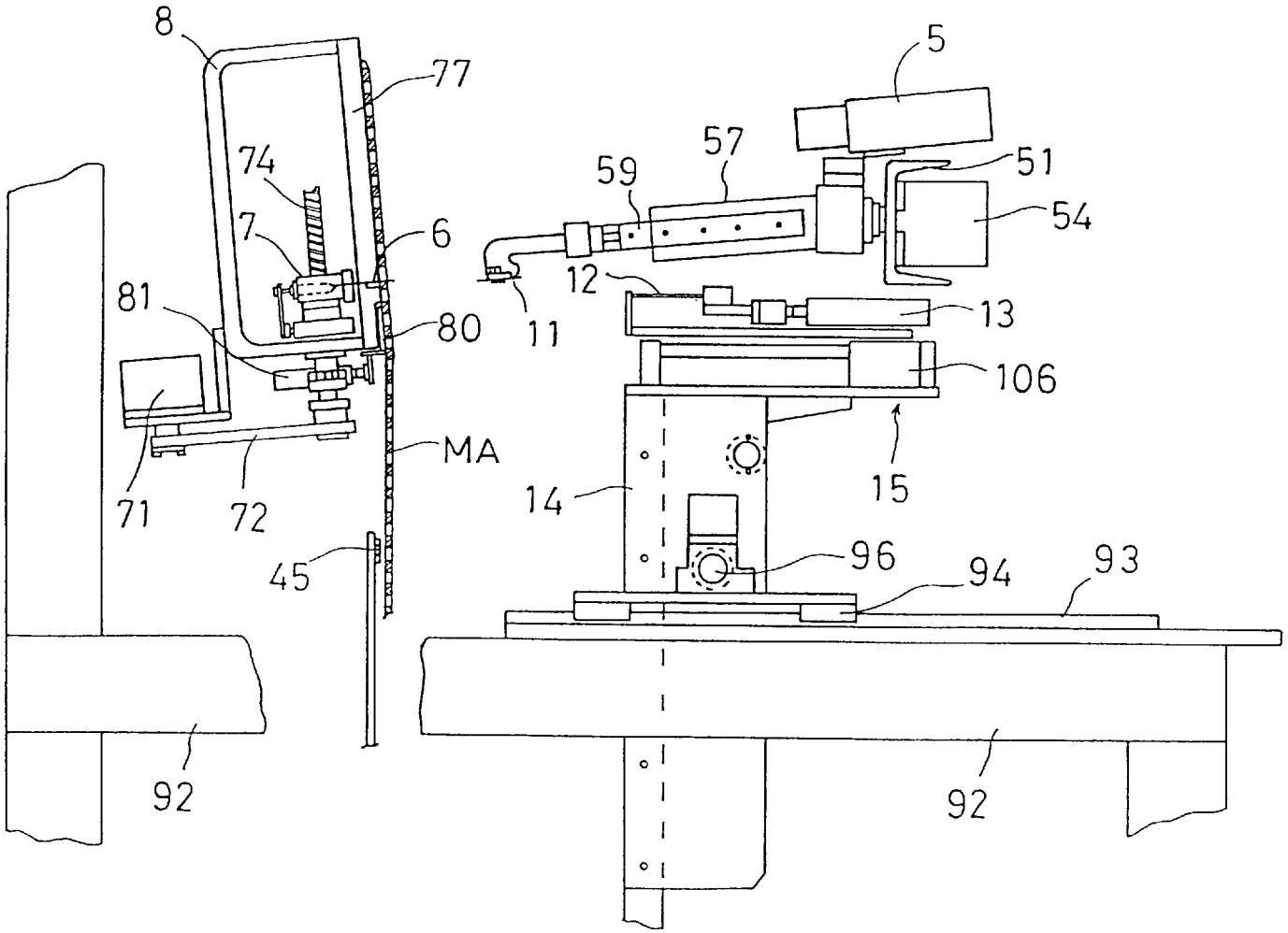
FIG. 19 is an enlarged side view of main portions of the supporting plate driving unit showing a first step of the operation from the cutting to the fabric transfer.

The fabric receiving needles 12 for receiving the fabric MA, the receiving table 14 including the air cylinder 13 for backward and forward motion of the fabric receiving needles 12, etc., and the driving mechanism 15 for the receiving table are constructed as shown in FIG. 18 and FIG. 19. In FIG. 18 and FIG. 19, the reference numeral 92 designates a pair of right and left device frames for integrally coupling and holding the unwinding device 3, the feeding mechanism 4, the pattern-matching unit box 8, etc. A slider 94 is engaged with and supported by rails 93 so as to be slidable backward and forward. The rails 93 are fixed to the opposing inner faces of the right and left device frames 92, respectively. The receiving table 14 is supported via a rotation shaft 96 by a receiving table lock cylinder 95 which is fixed on the slider 94, so as to be rotatable about the axis of the rotation shaft 96. The receiving table 14 is constructed in such a manner that its state can be switched between the normal fabric receiving state and the state in which the received fabric is taken out, via taper pins 97 and positioning holes 98 formed in the side plate portions of the receiving table 14.

A bearing 100 is rotatably supported at the tip end portion of each of the fixing shafts 99 which extended laterally and externally from both the side plate portions of the receiving table 14. A receiving table motion guide plate 101 having a guide groove 102 for rotatably supporting the bearing 100 is fixed on the inner face of each of the device frames 92. The guide grooves 102 of the receiving table motion guide plates 101 extend in a straight line along the horizontal face. A receiving table turning guide groove 103 having a ¼ circular arcuate shape is continuously formed at the rear end portion of each of the guide grooves 102. When the receiving table 14 is moved backward toward a cutting table 104 (see FIG. 28) along the rails 93, the bearings 100 are moved into the turning guide grooves 103, so that the receiving table 14 is automatically turned by 90°. As a result, the receiving table 14 is changed into a state for taking out the fabric to be cut. In addition, the fabric receiving needles 12 can be moved backward and forward along rails 105 via the backward and forward motion air cylinder 13, and also along rails 107 via a cylinder 106 for backward and forward motion of the receiving needle unit. The above-described components constitute the receiving table driving mechanism 15.

Figure 22:
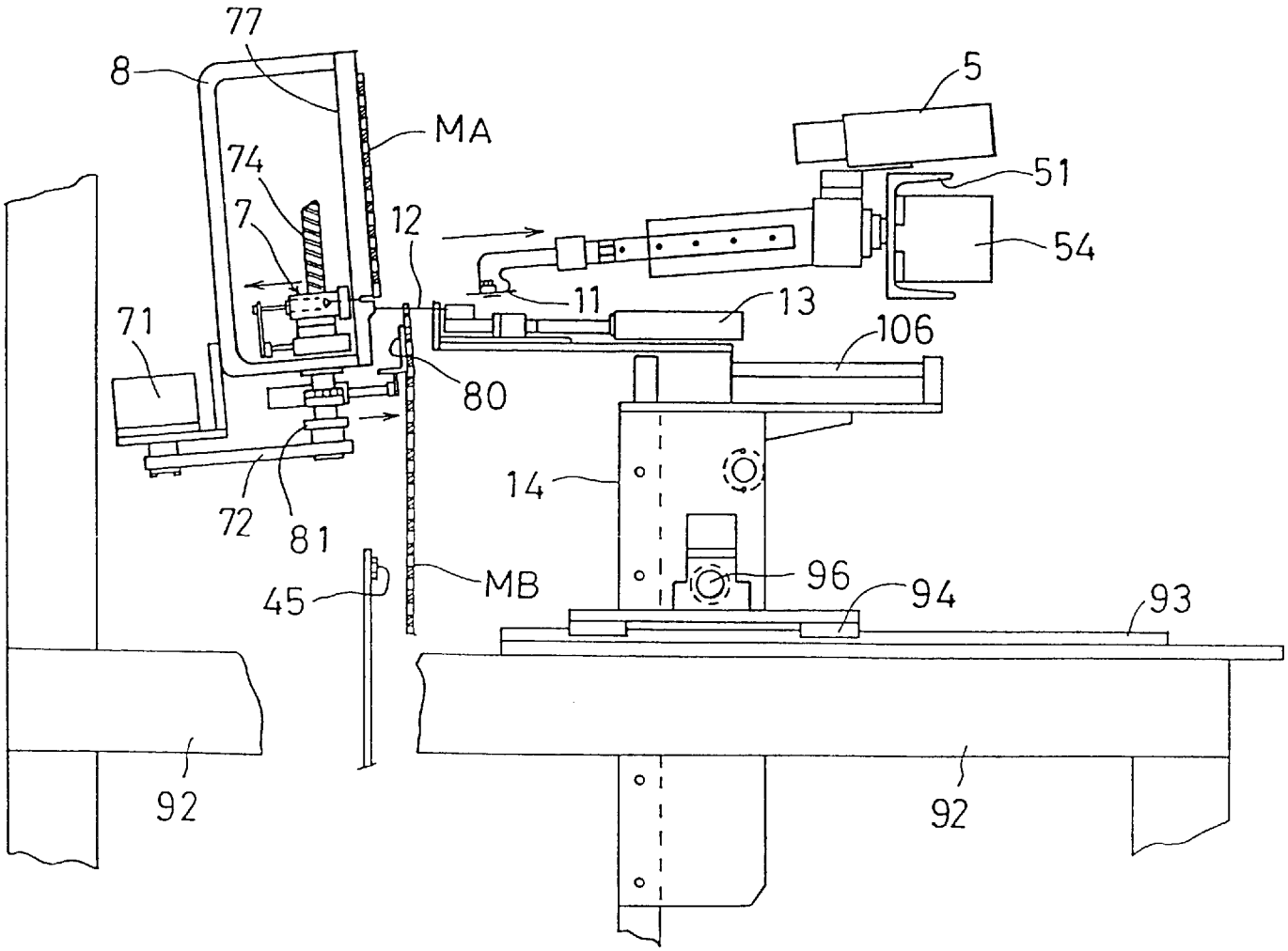
FIG. 22 is an enlarged side view of main portions of the supporting plate driving unit and showing a fourth step of the operation from the cutting to the fabric transfer.
Figure 23:
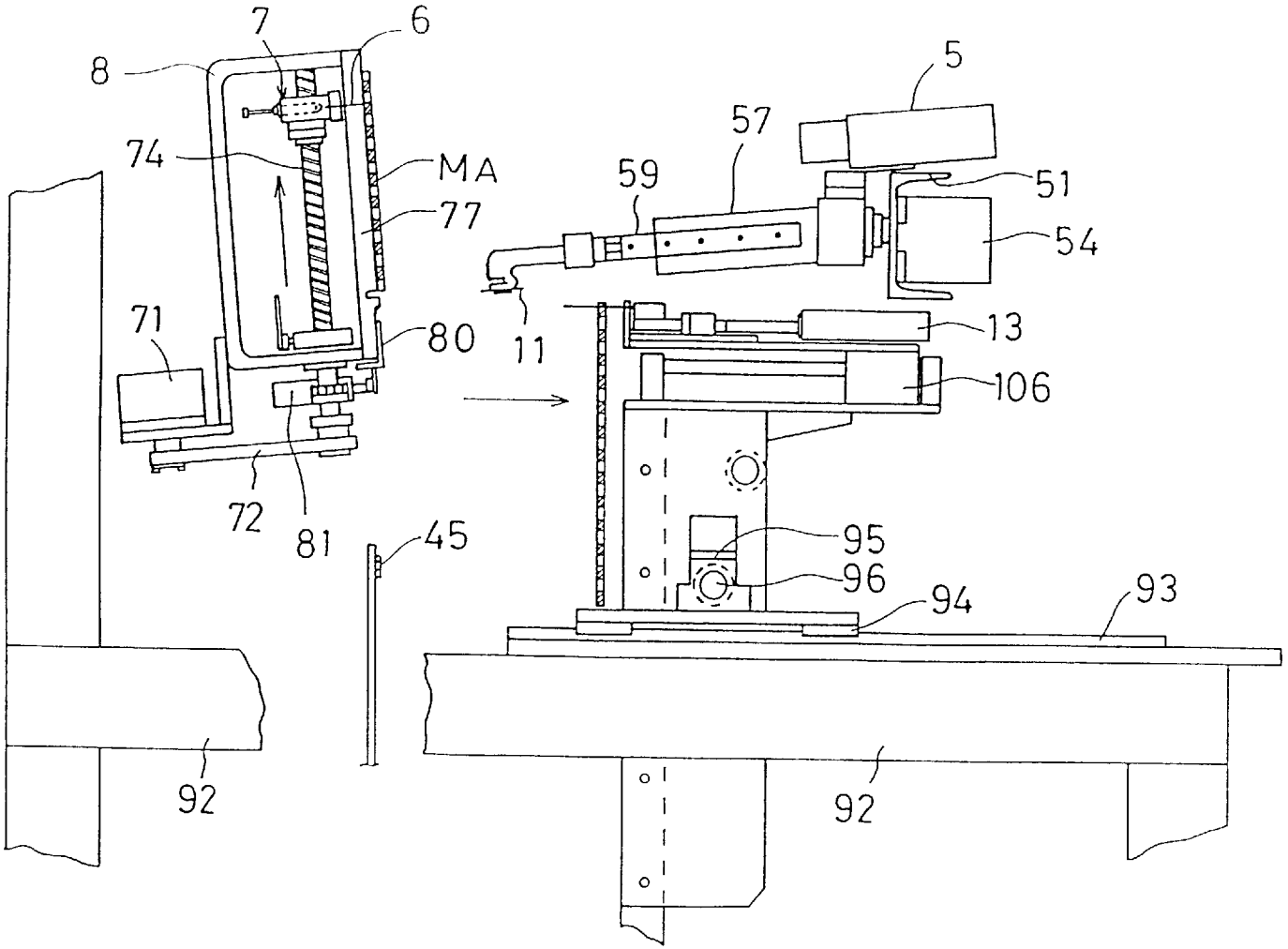
FIG. 23 is an enlarged side view of main portions of the supporting plate driving unit and showing a fifth step of the operation from the cutting to the fabric transfer.
Figure 24:
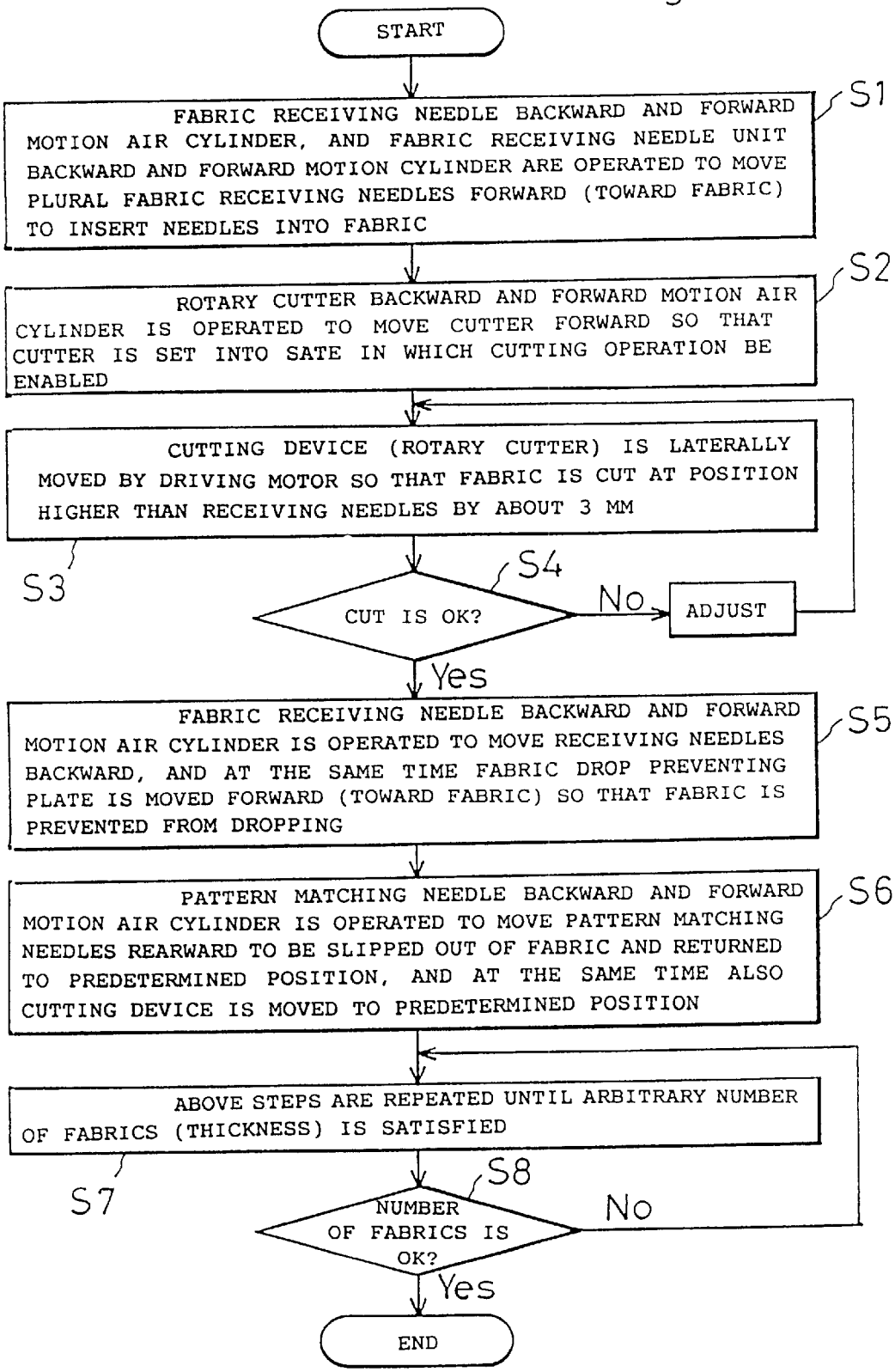
FIG. 24 is a flowchart illustrating the operation in FIGS. 19 to 23.
Figure 25:
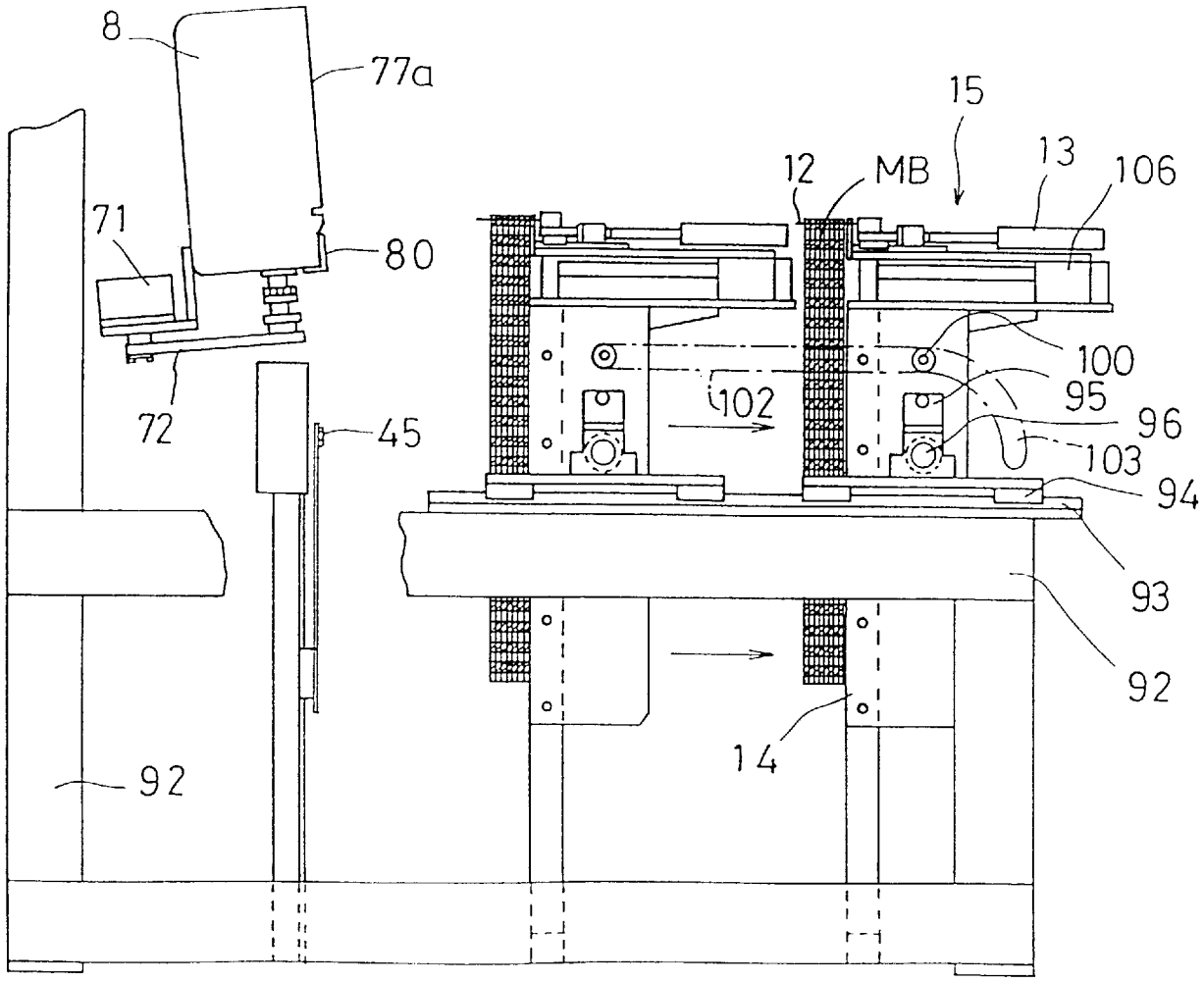
FIG. 25 is an enlarged side view of main portions of the supporting plate driving unit and showing a first step of the cut fabric taking-out operation.

Next, the operation of cutting the fabric MA, and a process of transferring the cut fabric to the receiving table 14 side which are performed after the above-described pattern matching operation for the fabric MA will be described with reference to the operational views shown in FIGS. 20 to 23, and the flowchart shown in FIG. 24.

Figure 20:
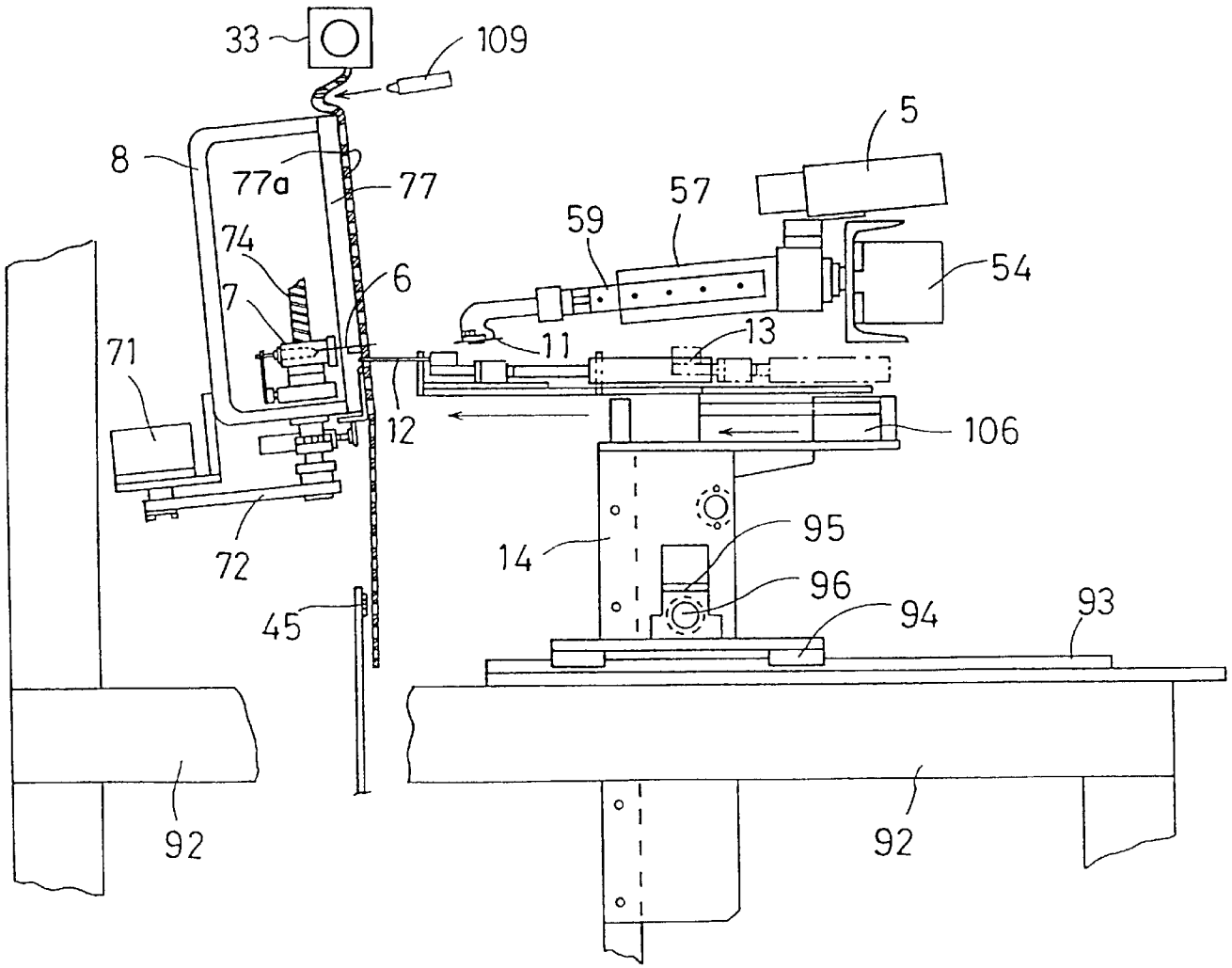
FIG. 20 is an enlarged side view of main portions of the supporting plate driving unit and showing a second step of the operation from the cutting to the fabric transfer.

First, as shown in FIG. 20, the fabric receiving needles 12 are moved forward by the extension operations of the receiving needle backward and forward motion air cylinder 13 and the receiving needle unit backward and forward motion cylinder 106, so that the needles are inserted into the hanging portion of the fabric MA (step S1).

Figure 21:
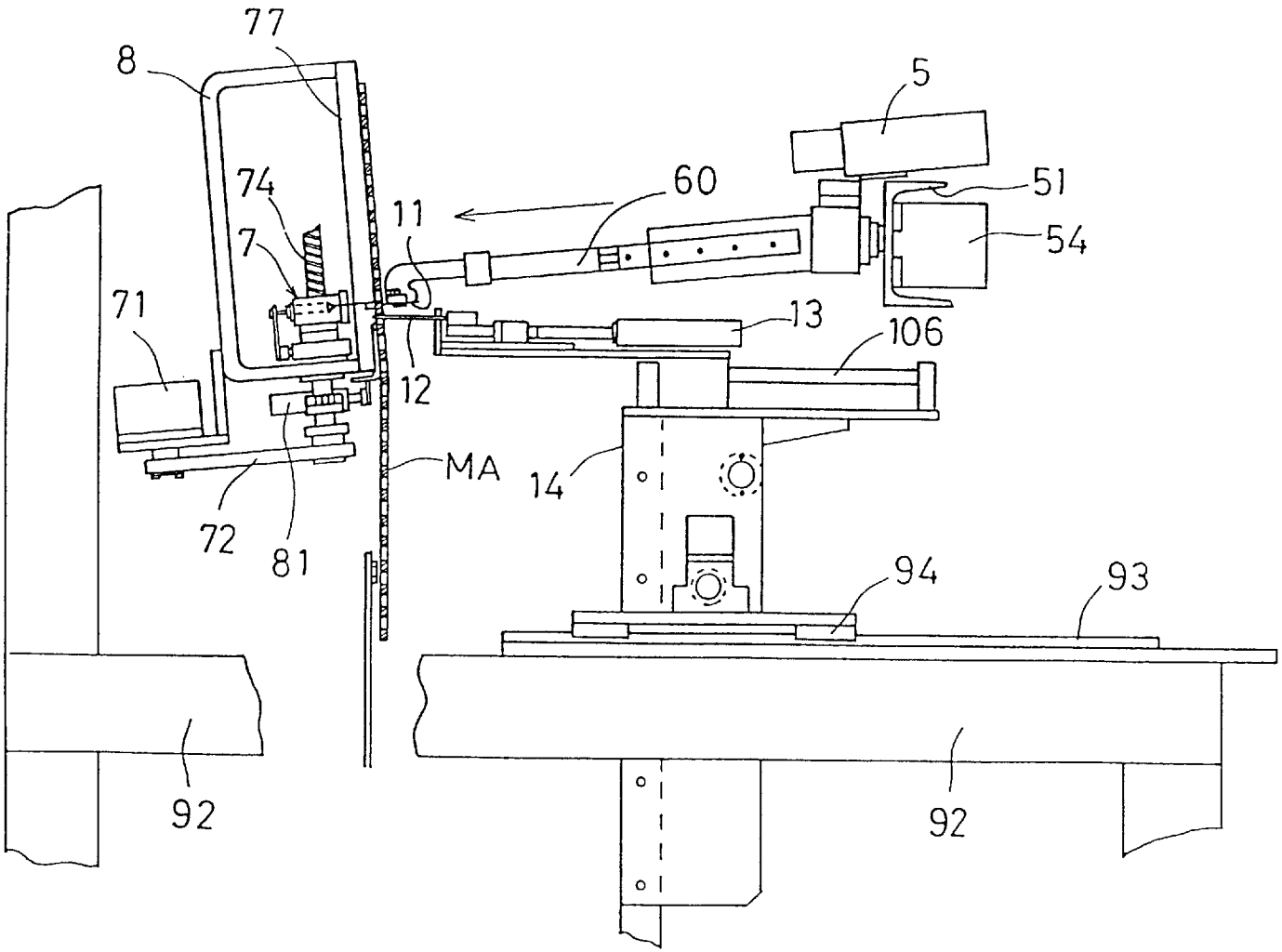
FIG. 21 is an enlarged side view of main portions of the supporting plate driving unit and showing a third step of the operation from the cutting to the fabric transfer.

Next, the pattern matching needles 6 are moved backward through the slits 78 via the air cylinder 76, so as to be slipped out of the fabric MA. The excess slack of the fabric MA is eliminated by the air blowing from the air blowing nozzles 109. Then, the extending operation of the air cylinder 60 causes the rotary cutter 11 to be moved forward, so that the cutter is set into the state in which the cutting operation can be conducted (step S2). In this state, while the air motor 61 is driven to rotate the rotary cutter 11, the rotary cutter 11 is laterally moved along the rail 52 via driving of the motor 54 as shown in FIG. 21, so that the fabric MA is cut at a position which is higher than the receiving needles 12 by about 3 mm (step S3). After such an operation of cutting the fabric MA is finished (step S4), the rotary cutter 11 is moved backward by the contracting operation of the air cylinder 60, and also the fabric receiving needles 12 are moved backward by the contracting operations of the receiving needle backward and forward motion cylinder 13 and the receiving needle unit backward and forward motion cylinder 106. At the same time, as shown in FIG. 22, the fabric drop preventing plate 80 is moved forward via the cylinder 81, so that the cut fabric MB is prevented from dropping from the fabric receiving needles 12 (step S5).

Next, the motor 71 for the pattern matching units 7 is driven, so that the unit elevating plate 75 is moved in the axial direction of the ball screws 74, i.e., in the upward direction with the rotation of the ball screws 74. As a result, all the pattern matching units 7 are moved to be returned to the predetermined upper limit position (home position). Moreover, as shown in FIG. 23, the fabric receiving needles 12 which hold the cut fabric MB in a suspending state are also moved to be returned to the original position, so that the cut fabric MB opposes the receiving table 14 which stands vertically (step S6). Thereafter, the above-described operation is repeatedly performed until the number of cut fabrics MB reaches a predetermined amount (steps S7 and S8).

Figure 27:
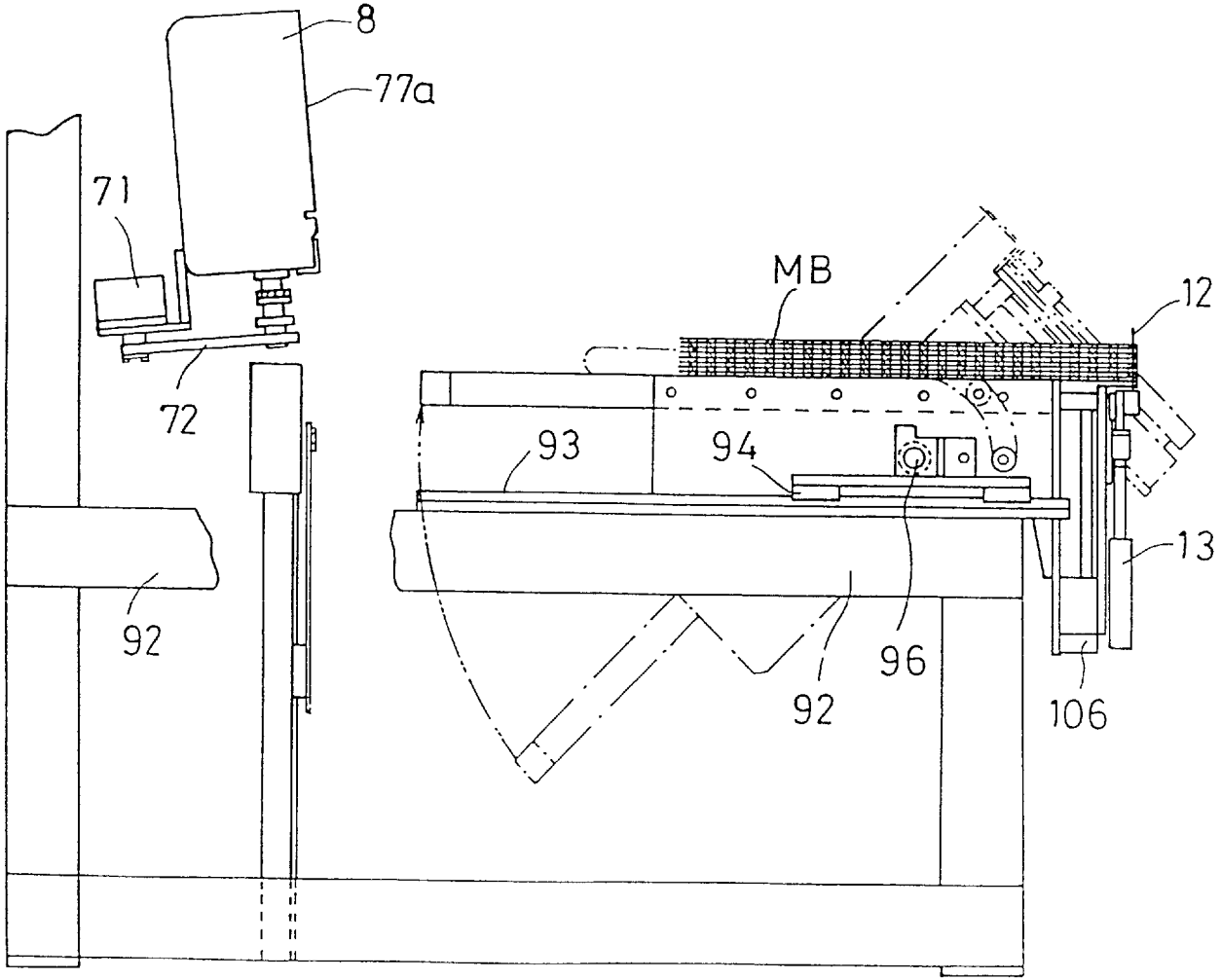
FIG. 27 is an enlarged side view of main portions of the supporting plate driving unit and showing a third step of the cut fabric taking-out operation.
Figure 28:
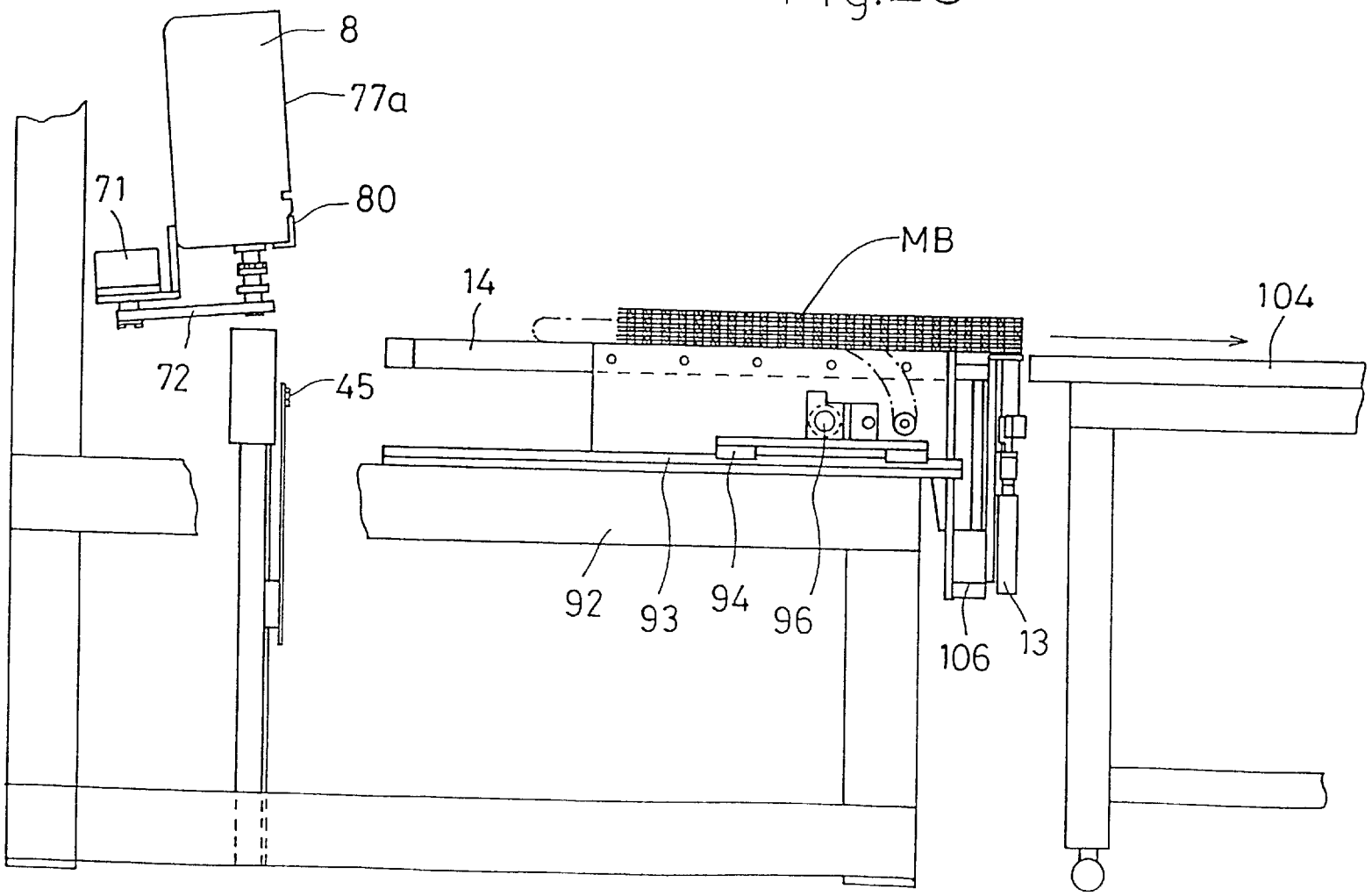
FIG. 28 is an enlarged side view of main portions of the supporting plate driving unit and showing a fourth step of the cut fabric taking-out operation.
Figure 29:
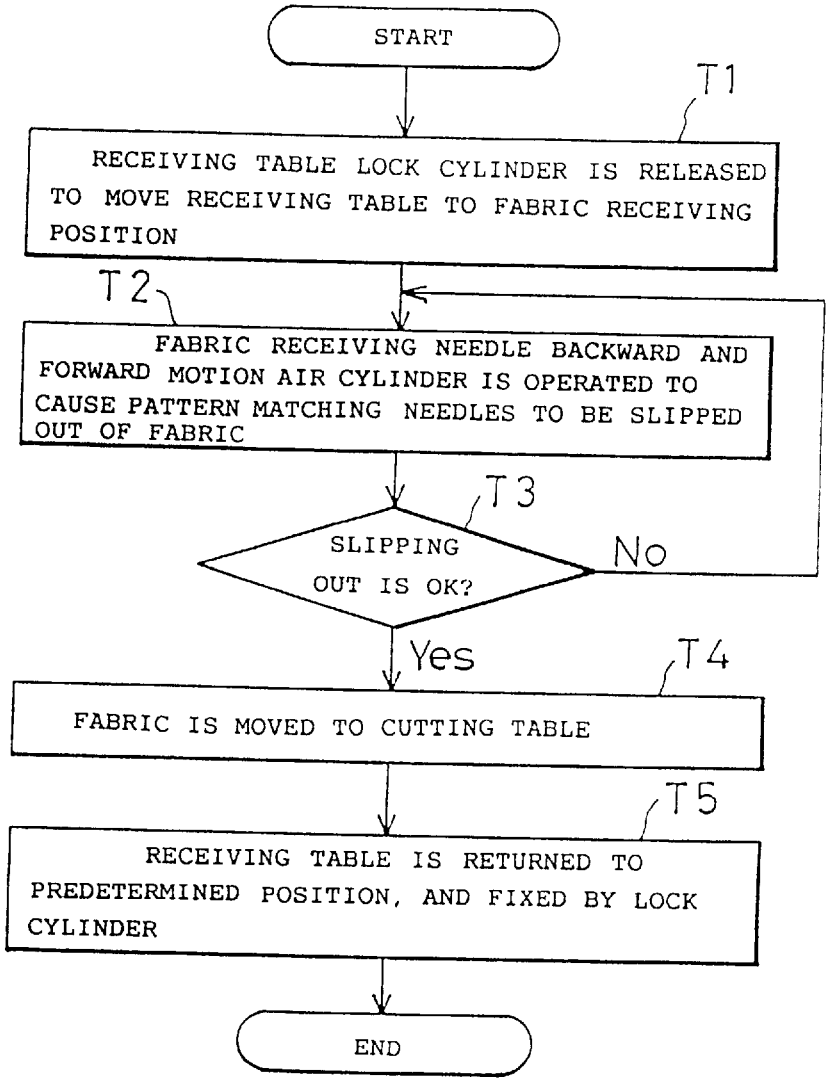
FIG. 29 is a flowchart illustrating the operation in FIGS. 25 to 28.

The process of changing the condition from that in which the predetermined number of cut fabrics MB are stacked by the fabric receiving needles 12 and vertically hung, to that in which the cut fabrics MB are taken out onto the cutting table 104 and stacked in a horizontal state will be described with reference to the operational views shown in FIG. 25 to FIG. 28, and the flowchart shown in FIG. 29.

Figure 26:
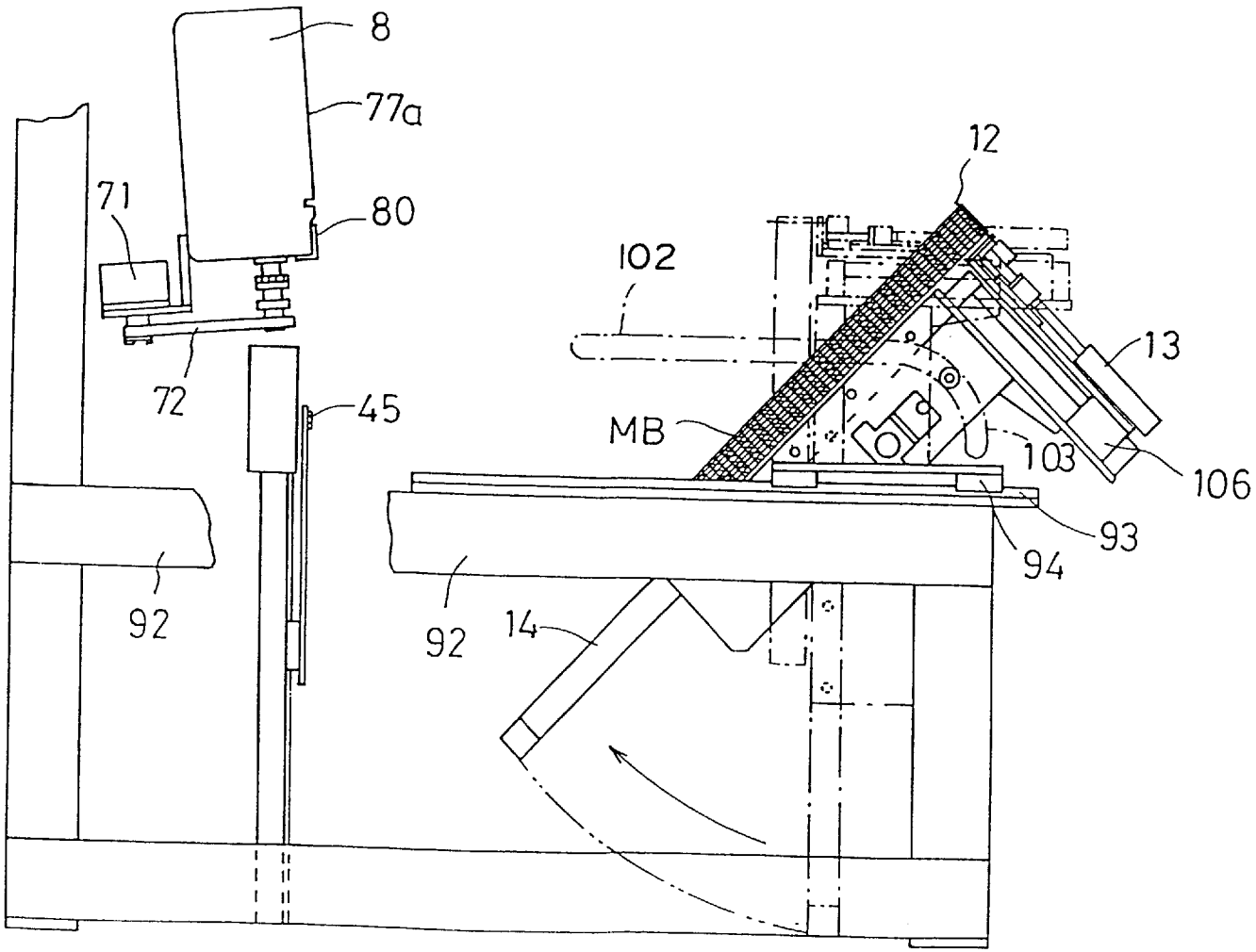
FIG. 26 is an enlarged side view of main portions of the supporting plate driving unit and showing a second step of the cut fabric taking-out operation.

First, the positional lock of the receiving table 14 is released via the receiving table lock cylinder 95, and thereafter the whole receiving table 14 is manually moved backward. At this time, when the bearings 100 are rotated and moved backward along the linear guide grooves 102 and reach the terminal point, the bearings 100 are transferred to the receiving table turning guide grooves 103 having an arcuate shape. As a result, as shown in FIG. 26 and FIG. 27, the receiving table 14, which stands vertically, is automatically turned by 90°, so that the condition is changed to a take out posture where the cut fabrics MB are stacked on the horizontal face (step T1).

When this state is established, the fabric receiving needles 12 are slipped out of the stacked cut fabrics MB by the contracting operation of the receiving needle backward and forward motion air cylinder 13 (step T2). When the slipping of the fabric receiving needles 12 out of the cut fabrics MB is confirmed (step T3), the stacked cut fabrics MB are transferred onto the cutting table 104 as shown in FIG. 28 via a transfer device which is not shown (step T4). Thereafter, the receiving table 14 is made to stand vertically and returned into the position for receiving cut fabrics, and then fixed via the receiving table lock cylinder 95 (step T5). The piled cut fabrics MB which have been transferred onto the cutting table 104 are cut into a predetermined shape by a cutting machine which is not shown.

In the embodiment described above the rotary cutter 11 is used as the fabric cutting device. For this purpose, the rotary cutter 11 is moved in the width direction of the fabric so as to cut the fabric. Alternatively, any other cutting device may be used.

Although the CCD camera 5 as shown in the embodiment is the most ideal one as the optical reading means, another device such as an optical line sensor may be used.

In the above embodiment, the fabric feeding mechanism 4 is composed of the fabric lower end position detecting sensor 41, the auxiliary roller 33 which is moved forward based on the detection signal of the sensor 41, the deflection detecting sensor 44 for detecting whether the slack amount of the fabric MA which is slacked in a substantially U-shape over the distance between the auxiliary roller 33 and the second unwinding roller 32 of the automatic fabric unwinding device 3, and the motor 36 for rotating the auxiliary roller 33. Alternatively, the fabric feeding mechanism 4 may be composed of a plurality of belts which are juxtaposed in the lateral width direction of the fabric MA and individually driven.

In addition, in the above embodiment, the sole CCD camera 5 is used, and the CCD camera 5 is constructed so as to be moved in the lateral directions (X, Y) via the belt 55 along the rail 52 of the fixing frame 51. Alternatively, a plurality of CCD cameras may be fixedly disposed at an appropriate interval in the lateral width direction of the fabric MA.

As described above, the automatic fabric pattern-matching apparatus of the present invention uses a technique in which a fabric for clothes or the like is fed from one longitudinal end thereof in a hanging manner, and the laterally continuous pattern formed on the fabric is read by optical reading means such as a CCD camera disposed so as to oppose the front face of the hanging portion, so that the longitudinal position of the fabric is controlled based on the read signal. Therefore, disadvantageous phenomena such as bias or bowed patterns are eliminated by the gravity exerted on the fabric. Particularly, the fabric pattern matching which is conventionally considered difficult because of various properties of knitted fabric and the like can be surely, precisely, and efficiently realized.

I claim:

1. An automatic fabric pattern-matching apparatus for automatically performing pattern matching with respect to a fabric having a pattern which is continuous at least in a lateral direction of the fabric, the fabric defining a front face and a back face, and being unwound from a wound fabric roll to define an unwound hanging fabric having a lower end portion, the wound fabric roll defining a longitudinal direction, said apparatus comprising: a fabric feeding mechanism for feeding the fabric unwound in a longitudinal direction from one end of the wound fabric roll in a direction generally normal to the longitudinal direction defined by the wound fabric roll, causing the fabric to take a position where the lower end portion hangs due to gravity; optical reading means, disposed adjacent to the front face of the lower end portion of the unwound hanging fabric, for recognizing the pattern on the fabric and generating a signal as a function of the pattern recognized; and control means for engaging the unwound hanging fabric in accordance with the pattern recognized and controlling the position of the unwound hanging fabric in the lateral direction of the fabric based on a signal from said optical reading means, as a result of which the pattern on the fabric forms a lateral straight line.

2. An automatic fabric pattern-matching apparatus for automatically performing pattern matching with respect to a fabric having a pattern which is continuous at least in a lateral direction of the fabric, the fabric defining a front face and a back face, said apparatus comprising: an automatic fabric unwinding device for unwinding the fabric from a wound fabric roll and spreading the unwound fabric; a fabric feeding mechanism for feeding the fabric unwound in a longitudinal direction from one end of the wound fabric roll in a direction generally normal to the longitudinal direction defined by the wound fabric roll, causing the fabric to define an unwound hanging fabric having a lower end portion and to take a position whereby the lower end portion hangs due to gravity; optical reading means, disposed adjacent to the front face of the hanging portion of the unwound hanging fabric, for recognizing the pattern on the fabric and generating a signal as a function of the pattern recognized; a fabric receiving and supporting plate disposed to oppose the back face of the hanging portion of the unwound hanging fabric, said fabric receiving and supporting plate having a back side and a sloped surface for receiving and supporting the hanging portion of the unwound hanging fabric as a result of which the lower end portion of the unwound hanging fabric is oriented further away from the wound fabric roll; a plurality of pattern matching units each including a pattern matching needle, said plurality of pattern matching units being disposed adjacent to the back side of said fabric receiving and supporting plate; mounting means for mounting said plurality of pattern matching units for movement toward and away from said unwound hanging fabric and in the longitudinal direction of the unwound hanging fabric, the pattern matching needles of said plurality of pattern matching units controlling the position of the fabric in the longitudinal direction by insertion of said pattern matching needles into the unwound hanging fabric as a function of a signal from said optical reading means whereby the pattern which is continuous in the lateral direction of the unwound hanging fabric forms a lateral straight line; and a fabric cutting device, disposed adjacent said optical reading means, movable toward and away from the unwound hanging fabric, for cutting the unwound hanging fabric which has been subjected to pattern matching in the width direction of the unwound hanging fabric by said pattern matching units.

3. An automatic fabric pattern-matching apparatus according to claim 2, further comprising: a shaft; and a fabric pressing device which presses the front side of the unwound hanging fabric received and supported on the sloped surface of said fabric receiving and supporting plate, said fabric pressing device being mounted at a position opposing the front face of the unwound hanging fabric and rotatable about said shaft to be moved in a pressure releasing direction, said shaft being set above the fabric pressing position, and said fabric pressing device comprises an air blowing device which blows air toward the unwound hanging fabric during the rotation and motion in the pressure releasing direction.

4. An automatic fabric pattern-matching apparatus according to claim 2, wherein said fabric feeding mechanism comprises: a fabric lower end position detection sensor for detecting the lower end position of the unwound hanging fabric; a roller which is moved relative to the unwound hanging fabric in response to a detection signal from said lower end position detection sensor; a deflection detection sensor for detecting whether a slack amount of the unwound hanging fabric which is slacked in a substantially U-shape between said roller and said automatic fabric unwinding device reaches a predetermined amount; and a motor for rotating said roller.

5. An automatic pattern-matching apparatus according to claim 2, further comprising: an edge detecting sensor for detecting an edge of said unwound hanging fabric, wherein said automatic fabric unwinding device comprises a roller, and said fabric feeding mechanism includes a roller, both rollers being adapted to be moved in the right and left lateral directions relative to said unwound hanging fabric in response to a detection signal from said edge detecting sensor.

6. An automatic fabric pattern-matching apparatus according to claim 2, further comprising: a unit box for accommodating said plurality of pattern matching units; and right and left device frames, wherein said fabric feeding mechanism, said optical reading means, said unit box, and said fabric cutting device are arranged in predetermined positional relationships, and integrally coupled and supported by said right and left device frames.

* * * * *